US005343689A

United States Patent [19]

Sasaki et al.

[11] Patent Number: 5,343,689

[45] Date of Patent: Sep. 6, 1994

[54] METHOD AND APPARATUS FOR SYNCHRONOUSLY PIECING ROVING FOR A CONTINUOUS FEEDING THEREOF TO A RING SPINNING FRAME

[75] Inventors: Kenji Sasaki, Komaki; Shinji Kato, Nagoya, both of Japan

[73] Assignee: Howa Machinery, Ltd., Aichi, Japan

[21] Appl. No.: 986,491

[22] Filed: Dec. 7, 1992

Related U.S. Application Data

[63] Continuation-in-part of Ser. No. 908,807, Jul. 7, 1992, abandoned, which is a continuation of Ser. No. 670,582, Mar. 18, 1991, abandoned.

[30] Foreign Application Priority Data

Mar. 22, 1990 [JP] Japan ..... 2-73133

[51] Int. Cl.[5] ..... D01H 13/04; D01H 5/28

[52] U.S. Cl. ..... 57/315; 57/90; 57/261

[58] Field of Search ..... 57/84, 85, 90, 91, 261, 57/315, 263; 19/157, 150, 159 A

[56] References Cited

U.S. PATENT DOCUMENTS

| | | | |
|---|---|---|---|
| 3,394,541 | 7/1968 | Rhyne | 57/91 |
| 4,089,155 | 5/1979 | Stahlecker | 57/263 |
| 4,799,353 | 1/1989 | Kawasaki et al. | 57/90 X |
| 4,838,018 | 6/1989 | Hoeber | 57/263 |
| 4,845,935 | 7/1989 | Mack | 57/261 |
| 4,899,531 | 2/1990 | Mack | 57/261 X |

FOREIGN PATENT DOCUMENTS

| | | |
|---|---|---|
| 0196127 | 10/1986 | European Pat. Off. . |
| 0213962 | 3/1987 | European Pat. Off. . |
| 0303577 | 2/1989 | European Pat. Off. . |
| 0310871 | 4/1989 | European Pat. Off. . |
| 62-57957 | 3/1987 | Japan . |
| 62-263332 | 11/1987 | Japan . |

*Primary Examiner*—Daniel P. Stodola
*Assistant Examiner*—William Stryjewski
*Attorney, Agent, or Firm*—Stevens, Davis, Miller & Mosher

[57] ABSTRACT

A method and apparatus for synchronously piecing rovings applied to a ring spinning frame in combination with a system of transporting roving bobbins by a bobbin carriage between a roving room and a spinning room, wherein rovings supplied from corresponding bobbins of a bobbin carriage in a creel portion of the ring spinning frame are synchronously pieced with corresponding supplemental rovings taken from respective full packaged roving bobbins held by another bobbin carriage in the creel portion of the ring spinning frame.

14 Claims, 13 Drawing Sheets

METHOD AND APPARATUS FOR SYNCHRONOUSLY PIECING ROVING FOR A CONTINUOUS FEEDING THEREOF TO A RING SPINNING FRAME

This is a continuation-in-part of U.S. Ser. No. 07/908,807, filed Jul. 7, 1992, (abandoned), which is a continuation of U.S. Ser. No. 07/670,582, filed Mar. 18, 1991, (abandoned).

BACKGROUND OF THE INVENTION

DESCRIPTION OF THE RELATED ART

As disclosed in Japanese Unexamined Patent Publication Sho 62 (1987)-57957, it is well known that, in a conventional system, when roving bobbins from which rovings are fed to draft parts of a ring spinning frame become almost exhausted and small in size and the yarn packages of the spinning frame reach a predetermined size after the completion of forming a starting portion thereof, i.e., one-third of a full package size thereof, supplemental rovings are taken from the full packaged roving bobbins. These bobbins are prepared in advance in a creel part of a ring spinning frame, during a predetermined period between a time at which the size of the yarn packages reaches one-third of the full yarn package size and a time at which the size of the yarn package becomes 90% of the full yarn package size, and these rovings are carried to positions right above trumpets of the corresponding draft parts of the ring spinning frame, respectively. Thereafter, the above-mentioned supplemental rovings are combined with corresponding rovings fed from the almost exhausted roving bobbins, respectively, and the rovings, which are connected to the respective roving bobbins, are separated from the combined portion of the rovings immediately after the above-mentioned combination. The above-mentioned unit operation is carried out from one end of the spindle alignment of the ring spinning frame to the other end, by utilizing a roving piecing apparatus having a function of synchronously carrying out the unit operation for a group of a plurality of successive spindles, for example, two to six spindles. It is also possible to carrying out the above-mentioned unit operation manually.

In the above mentioned roving piecing operation utilizing the apparatus disclosed in the above-mentioned prior art, the unit operation by the apparatus is carried out by successive operations such as a first operation for reserving supplemental rovings at the respective positions close to the trumpets of the corresponding draft parts, and a second operation, i.e., the joint piecing operation of supplemental rovings with the corresponding rovings, which are fed from the respective roving bobbins, at the above-mentioned positions, and a third operation of cutting the rovings which are supplied from the respective roving bobbins arranged at the creel portion of the ring spinning frame, at the respective positions upstream of the corresponding trumpets of the draft parts, and the above-mentioned unit operation by the apparatus is successively carried out by displacing the apparatus along the spindle alignment. Therefore, the time required to carry out the roving piecing operation at the time of exchanging almost exhausted roving bobbins for the full packages roving bobbins, utilizing the above-mentioned known apparatus is fairly long. This problem becomes more serious when producing a coarse count yarn, which is preferably produced by utilizing a ring spinning frame having a larger number of spindles than the standard size spinning frame, because the time required to produce the full size yarn package is shorter than the time required to complete the successive roving piecing operation for all spindles of the ring spinning frame. Accordingly, the above-mentioned roving piecing method and apparatus are not suitable for producing a coarse count yarn.

SUMMARY OF THE INVENTION

The present invention is based on the following technical concept. Namely, it is well known that the yarn piecing operation of a ring spinning frame is carried out in a period between a time at which the size of the yarn package reaches one-third of the full size thereof and a time at which the size of the yarn package becomes 90% of the full size thereof, because the spinning condition, such as a variation of yarn tension, are very stable, and thus the average yarn tension is such that possible yarn breakages will not occur. Nevertheless, even during the above-mentioned period since the ring rail is stepwisely raised upward while repeating the traverse lifting motions thereof to create chases, and as it is well known that, in each chase formation, the size of the ballooning created in a condition such that the ring rail of the ring spinning frame takes a higher position is normally smaller than the size of the ballooning created in a condition such that the ring rail takes a lower position. Therefore, if the roving piecing operation is carried out in a restricted period during which the ring rail takes a position as close as possible to the uppermost position of the ring rail in a chase formation, the roving piecing operation can be carried out in a condition such that possible yarn breakage will not occur. Therefore, since the chase forming is carried out synchronously for all spindles of the ring spinning frame, if the roving piecing operation is synchronously carried out for all of the draft parts for which the roving piecing operation is required, the above-mentioned desirable condition for carrying out the roving piecing operation can be created.

Based upon the above-described technical concept, in the roving piecing method according to the present invention, supplemental rovings are taken from the corresponding supplemental full size roving bobbins, which are located at the creel position of a ring spinning frame, and these rovings are carried to respective standby reserve positions close to the corresponding rovings being fed to the corresponding draft parts respectively, during the above-mentioned desirable period, and when the roving bobbins mounted at the creel position of a ring spinning frame reach an almost exhausted condition, the supplemental rovings from the supplemental roving bobbins are introduced synchronously into the respective draft parts together with the corresponding rovings from the almost exhausted roving bobbins, while the rovings from the almost exhausted roving bobbins are separated from the above-mentioned rovings which are being fed to the respective draft parts, immediately after the above-mentioned operation, hereinafter referred to as "joint piecing operation". The above-mentioned roving piecing operation is carried out synchronously at all draft parts to which the rovings are being fed from the respective almost exhausted roving bobbins held by a bobbin carriage supported at the creel position of the ring spinning frame. Therefore, the time required to complete the roving piecing operation can be remarkably reduced when compared with the known method. Moreover, if the above-mentioned synchronous operation is carried out at the time that the ring rail takes a position for forming the upper end portion of each chase formation, since the roving piecing operation is carried out in the most desirable condition for preventing possible yarn breakage(s) in the roving piecing operation, a most effective continuous spinning operation can be carried out.

To carry out the synchronous roving piecing method of the present invention, in the apparatus for carrying out the above-mentioned method according to the present invention, it is essential to provide a means for synchronously reserving free end portions of supplemental rovings taken from the respective supplemental roving bobbins at the respective positions in the trumpets of the corresponding draft parts, wherein each position is close to the passage of the roving fed from the roving bobbin which is supplying the roving to the identical draft part, a means for synchronously introducing the above-mentioned free end portions of the supplemental rovings into the corresponding draft parts in a doubled condition with the corresponding rovings which are being fed from the respective roving bobbins which have reached an almost exhausted condition, so that a joint piecing operation of the respective supplemental rovings to the corresponding rovings which are being fed to the corresponding draft parts is completed, and a means for cutting the rovings at the respective positions upstream of the corresponding draft parts immediately after the completion of the above-mentioned joint piecing operation.

Nevertheless, in the practical apparatus for carrying out the synchronous roving piecing method according to the present invention, the above-mentioned essential means for carrying out the synchronous roving piecing operation are designed in another combination, i.e., machine elements of the practical apparatus perform parts of the functions of the above-mentioned means respectively, so that the essential function of completing the synchronous roving piecing operation according to the present invention can be created by the combination of the functions of the machine elements of the practical apparatus as hereinafter explained in detail.

DESCRIPTION OF THE PREFERRED EMBODIMENTS

The present invention is carried out in cooperation with a conventional roving bobbin transporting system utilizing main transporting rails arranged between a room wherein a plurality of roving frames are installed and a room wherein a plurality of ring spinning frames are installed. In this roving bobbin transporting system, each bobbin carriage is provided with a plurality of bobbin hangers and is capable of carrying roving bobbins along the transporting rail between a particular position in the roving room and a particular position in the ring spinning frame. This transporting system is well known in the art, however, and therefore, a detailed explanation thereof is omitted, except for the points which are necessary to the explanation of the present invention.

Next, the first embodiment of the present invention is hereinafter explained in detail with reference to FIGS. 1, 2, 3, 4, 5, 6, 7 and 8.

Figure 5:
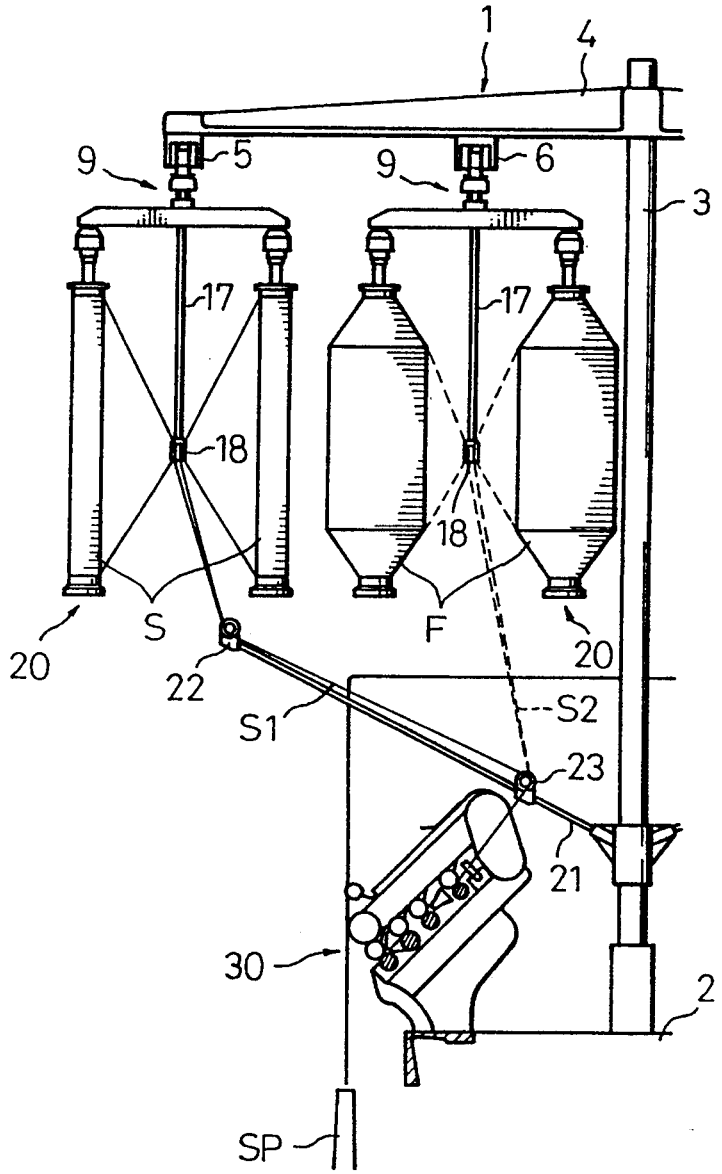
FIG. 5 is a side view of the creel portion of the ring spinning frame shown in FIG. 1.
Figure 6:
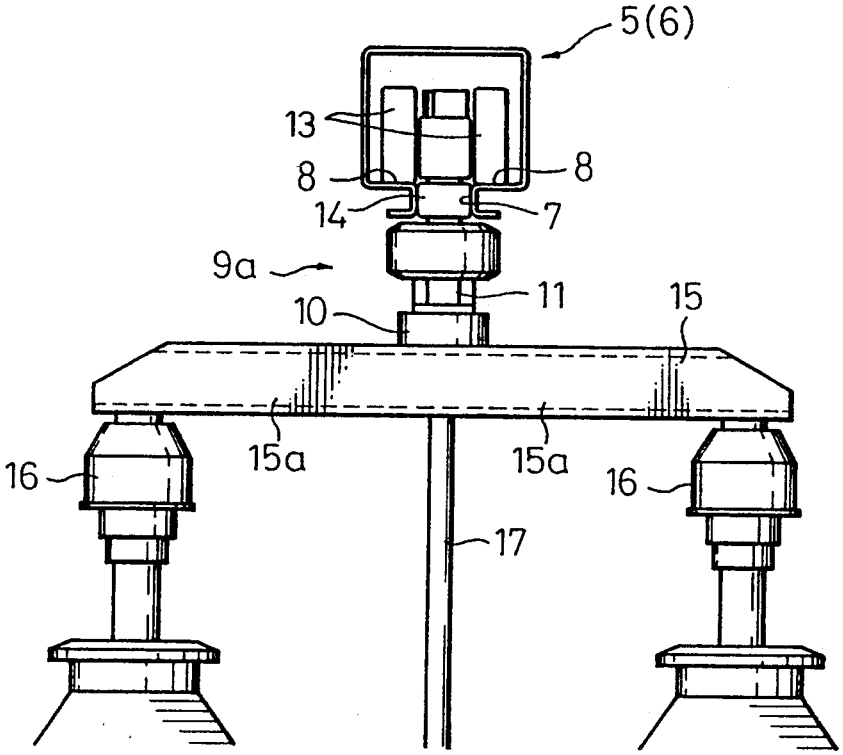
FIG. 6 is a side view of a rail for transporting a bobbin carriage concerned with the present invention.
Figure 7:
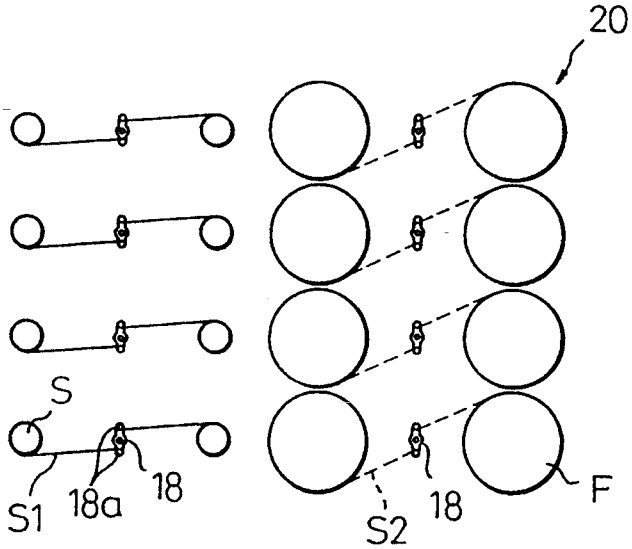
FIG. 7 is an explanatory view of the positional relationship between the roving bobbins and roving guides concerned with the present invention.

As shown in FIG. 5, horizontal supporting arms 4 are rigidly mounted on upper end portions of creel pillars 3, which are vertically and rigidly mounted on a machine frame 2 of a ring spinning frame, with a predetermined pitch along the lengthwise direction thereof. At each side of the spinning frame, a pair of supporting rails 5, 6 are secured to these supporting arms 4 in parallel along the lengthwise direction of the spinning frame, whereby a creel portion 1 is formed at each side of the spinning frame. The supporting rails 5 and 6 are connected with a main transporting rail (not shown) at each terminal portion thereof, respectively. The main transporting rail and the supporting rails 5 and 6 have an identical cross-sectional construction. As shown in FIG. 6, these supporting rails 5, 6 are provided with a hollow frame having a rectangular cross section and a guide opening portion 7 formed at a bottom portion of the hollow frame such that the guide opening 7 extends along the lengthwise direction of the hollow frame, so that a pair of inside guide surfaces 8 are formed inside the hollow frame at both sides of the guide opening portion 7, respectively. As shown in FIG. 5, a bobbin carriage 9 is displaceably supported by the main transporting rail (not shown) and the supporting rails 5, 6. As is well known in the art, each bobbin carriage 9 is provided with a plurality of carriage elements 9*a* connected in an alignment. As shown in FIG. 6, each carriage element 9*a* comprises a carriage bar 10 and a pair of vertical supporting rods 11 rigidly mounted on the upper surface of the carriage bar 10 at both end portions thereof. Each supporting rod 11 is provided with a guide roller 14 rotatable about the central axis thereof. Accordingly, when each carriage element 9*a* of the bobbin carriage 9 is assembled with the main transporting rail (not shown) and one of the supporting rails 5 and 6, the guide roller 14 is rotatably guided by the opening 7 of the main transporting rail (not shown) and the supporting rail 5 or 6. A pair of rotation rollers 13 are secured on a horizontal shaft (not shown) which passes rotatably through the vertical supporting rods 11 at the top end portion thereof in a condition such that, when the bobbin carriage 9 is assembled with the main transporting rail and supporting rails 5 and 6, the rotation rollers 13 are able to rotate on the corresponding inside surfaces 8,8 of the hollow frame of the main transporting rail and the supporting rails 5 and 6, respectively. The carriage bar 10 is provided with a plurality of horizontal frames 15 rigidly mounted thereon in a condition such that a pair of horizontal wing portions 15*a* of an identical length are extended to the outer sides from a central point thereof, and the angle between each wing portion 15*a* and the lengthwise direction of the carriage bar 10 is fixed at 90 degrees. Each wing horizontal frame 15 is provided with a vertical rod 17 extended from a central point thereof. These horizontal frames 15 are arranged at an identical predetermined pitch which is double that of the spindle pitch, and bobbin hangers 16 are rigidly supported by each horizontal frame 15 at both end portions of the wing portions 15*a* thereof. As shown in FIG. 7, a roving guide 18 is mounted on the bottom end portion of each vertical rod 17, and each roving guide 18 is provided with a pair of guide pins 18*a* formed at both sides of the vertical rod 17 in a condition such that each guide pin 18*a* is directed upward. A plurality of the carriage bars 9*a* are connected in alignment by utilizing universal joints 19 (FIG. 8) to form the bobbin carriage 9, so that the number of bobbin hangers 16 of each bobbin carriage 9 is identical to ½ the number of spindles at each side of the spinning frame, in other words, the total number of bobbin hangers 16 of each bobbin carriage 9 is identical to the total number of spindles at each side of the spinning frame.

The above-mentioned bobbin carriage 9 is transported along the main transporting rail (not shown) and the supporting rails 5 and 6 by a suitable means for displacing the bobbin carriage between the roving room and the ring spinning room, such as a carrying apparatus (e.g., a battery car as disclosed by Japanese Unexamined Patent Publication Sho 62 [1987]-263332, etc.). A supporting bar 21 (FIG. 9) is rigidly mounted on each creel pillar 3 and a pair of guide bars 22, 23 are horizontally supported by the supporting bars 21 in a condition such that these guide bars 22, 23 extend the entire length of the spindle alignment of each side of the spinning frame, so that rovings S1 supplied from the respective bobbins supported by the corresponding bobbin hangers 16 of the bobbin carriage 9 positioned at the creel position of the ring spinning frame are fed to the corresponding draft parts by way of the roving guides 18 and roving guide bars 22, 23. Rovings S2 from the supplemental roving bobbins supported by the corresponding bobbin hangers 16 of the bobbin carriage 9 positioned at the other creel position of the ring spinning frame are also introduced to the corresponding draft parts in the same condition as mentioned above, when the synchronous roving piecing operation according to the present invention is carried out.

Figure 1:
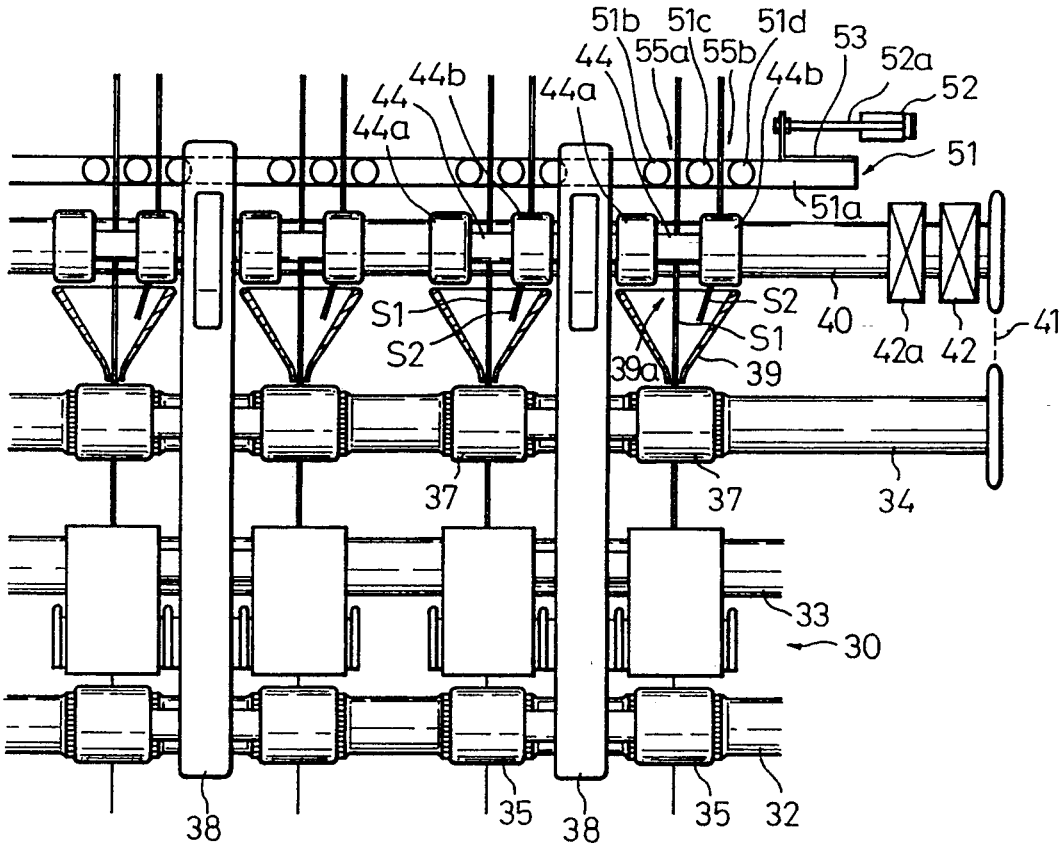
FIG. 1 is a plan view of a plurality of draft parts of a ring spinning frame to which the present invention is applied.
Figure 3:
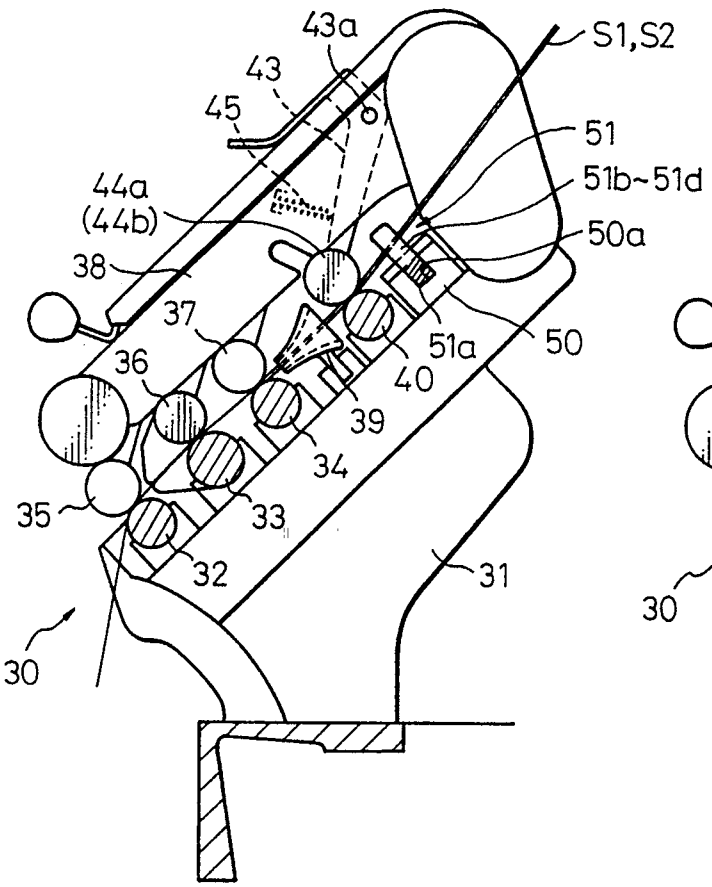
FIG. 3 is a cross sectional view of the draft parts shown in FIG. 1.

As shown in FIG. 5, the draft parts 30 are disposed on the corresponding roller stands 31 at a position below the arrangement of the supporting bars 21. The main portion of the synchronous roving piecing apparatus (first embodiment) of the present invention is shown in FIGS. 1 and 3. That is, in each draft part 30, top rollers 35, 36, and 37 are disposed on a front roller 32, a second roller 33 and back roller 34, respectively, in a rotatable condition at both sides of a top arm 38, and trumpet 39 is disposed at an entrance of each back roller 34. The opening portion of the trumpet 39 is expanded to be larger than that of the conventional trumpet to attain the purpose of the present invention. Namely, since the opening of the trumpet 39 is expanded, the rovings S1 and S2 can be introduced therein synchronously when the joint roving piecing operation of the present invention is carried out.

A supplemental common feed roller 40 is rotatably mounted in the draft parts of the spinning frame at a position closely upstream of the trumpets 39 in a condition such that the roller 40 extends along the entire length of the spinning frame. The supplemental feed roller 40 is driven by a suitable drive system 41 such as a gear train, at a surface rotation speed equal to that of the back roller 34 and the starting and stopping of the rotation of the roller 40 is controlled by a clutch and brake mechanism comprising a clutch and a brake 42*a*, which is arranged between the drive system and the supplemental feed roller 40, as shown in FIGS. 1 and 2.

Figure 2:
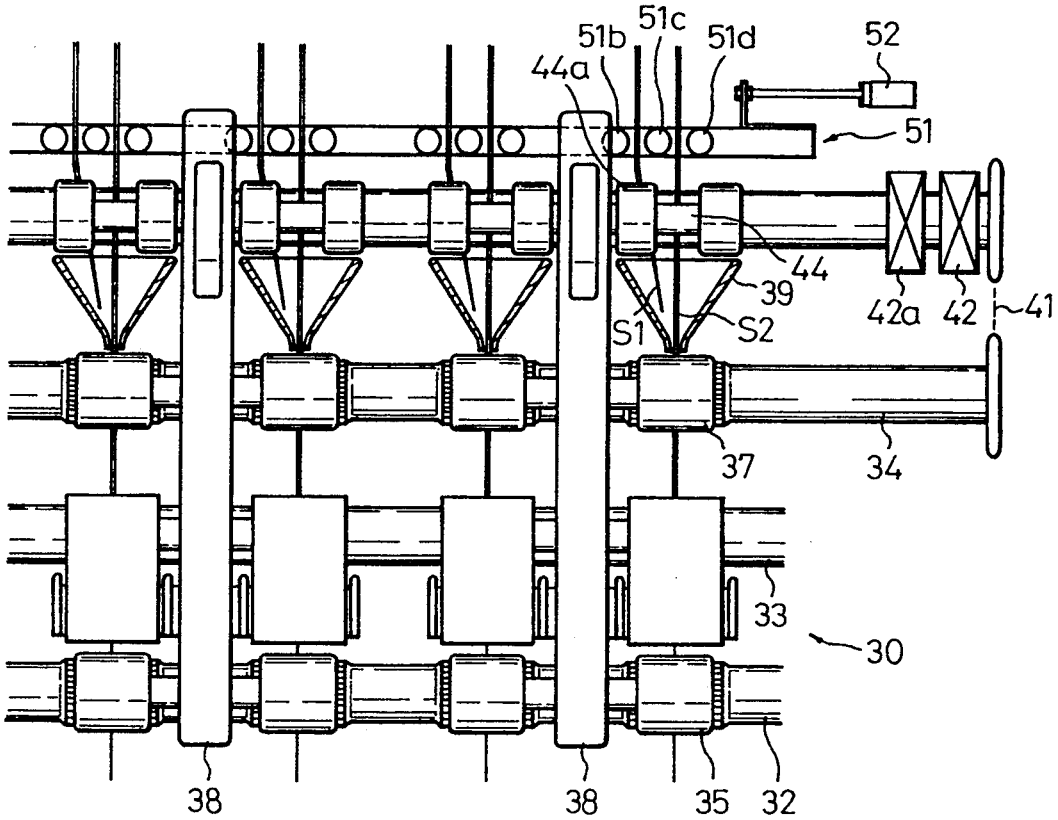
FIG. 2 is a plan view of the draft parts shown in FIG. 1, wherein a condition in which the synchronous roving piecing operation is completed is shown.
Figure 4:
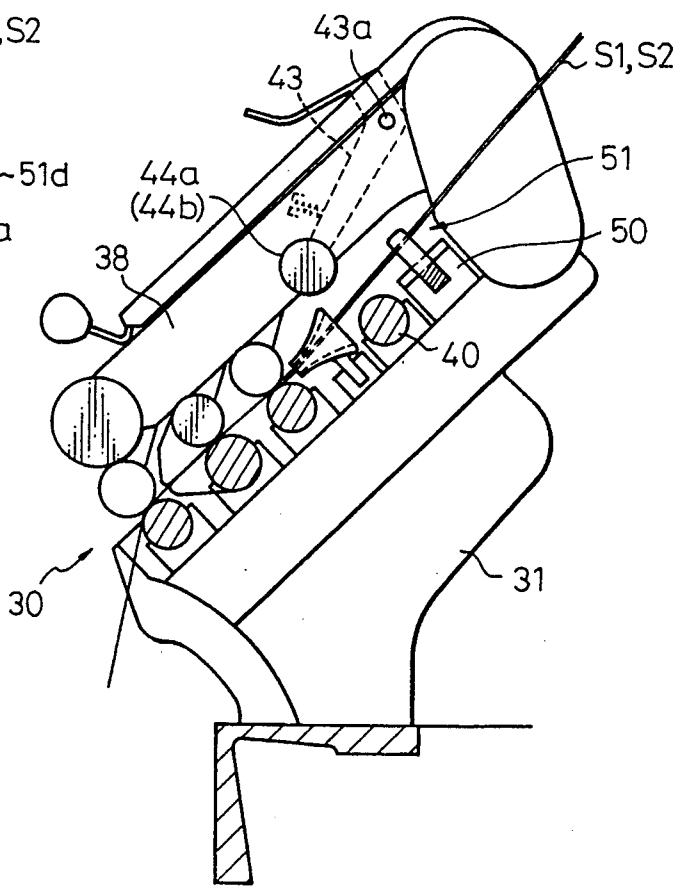
FIG. 4 is a cross sectional view of the draft parts shown in FIG. 1, showing the condition wherein a nip roller of a mechanism for feeding a roving is released from a supplemental roving bobbin.

A bifurcate lever 43 is provided and comprises two elementary lever portions connected to each other, and is mounted in swingable condition about a horizontal axis 43*a* mounted on each top arm 38, and a horizontal supporting shaft 44 is mounted so that a pair of nip rollers 44*a* and 44*b* are rotatably mounted on the shaft 44 in a condition such that these nip rollers 44*a* and 44*b* are projected toward an outer side from the top arm 38 respectively, to take respective positions at both sides of the roving S1 supplied to the corresponding draft part as shown in FIGS. 1 and 2. Each bifurcate lever 43 is provided with a coil expansion spring 45 between the top arm 38 and the upper elementary lever portion so that, when the top arm 38 is set at the working position thereof, the nip rollers 44*a* and 44*b* are pressed against the supplemental feed roller 40 in a rotatable condition as shown in FIG. 3. Therefore, the above-mentioned contact between the supplemental feed shaft 40 and the nip rollers 44*a*, 44*b* can be released by turning the lever 43 upwards about the horizontal axis 43*a* of the top arm 38.

A solid support member 50 is rigidly mounted on each roll stand 31 as shown in FIG. 3. Each solid support member 50 is provided with a guide groove 50*a* having a rectangular cross section. A roving guide member 51 extending the entire length of the spindle alignment is slidably inserted in the guide groove 50*a* of each solid supporting member 50, for controlling the supply direction of the rovings S1 and S2, respectively, to the trumpet 39 of each draft unit 30. The roving guide member 51 comprises a solid rod 51*a* having a rectangular cross section and provided with a plurality of sets of three guide pins 51*b*, 51*c* and 51*d* projecting outwardly from the upper surface thereof in the respective positions for controlling the introducing positions of the sliver S1 and the sliver S2 into each draft part 30. At one side end of the rod 51*a*, a bracket 53 is connected to a piston rod 52*a* of a reciprocal pneumatic cylinder 52, so that the transversal reciprocal motion of the roving guide member 51 along the lengthwise direction of the spinning frame can be obtained. The relative position between the arrangement of the guide pins 51*b*, 51*c* and 51*d* and the arrangement of the nip rollers 44*a* and 44*b* is designed to satisfy the following condition. That is, when one of roving guide spaces 55*a* and 55*b* formed between the guide pins 51*b* and 51*c*, 51*c* and 51*d*, respectively faces one of the nip rollers 44*a* and 44*b*, in a condition such that the roving guide member 51 is stopped at either one of the terminal points of the reciprocal stroke motion of the piston rod 52*a* of the cylinder 52, the other one of the roving guide spaces 55*a* and 55*b* is at an intervening position between the nip rollers 44*a* and 44*b*. The function of the roving guide member 51 is to act as a means for synchronously cutting the slivers S1 (S2) fed to the corresponding draft parts 30.

Next, the function of the above-mentioned apparatus for synchronously piecing rovings is hereinafter explained in detail. Since the function of the apparatus of the present invention is identical with respect to both sides of the ring spinning frame, the following explanation is directed only to one side of the spinning frame.

For the sake of better understanding of the function of the apparatus (first embodiment), the following explanation is directed to the condition that the rovings are supplied to the corresponding draft parts from the bobbin carriage 9 and the supporting rail 5, while full packaged roving bobbins are introduced to their standby position where the bobbin carriage 9 holding these full packaged roving bobbins is introduced to the supporting rail 6. That is, during a period in which the spinning operation is normally carried out, the rovings S1 are continuously supplied from the roving bobbins S of two parallel alignments of the bobbin carriage 9 temporarily located at a creel position of a ring spinning frame represented by the supporting rail 5, at corresponding draft parts of each side of the ring spinning frame, respectively in each draft part 30, the roving S1 is introduced to the trumpet 39 of the corresponding draft part 30 by way of the roving guide 18, the roving guide bars 22 and 23, and the intervening space 55*a*, and therefore, a bundle of fibers delivered from the draft part 30 is twisted and wound on a bobbin mounted on the corresponding spindle. During a fairly long interval until the roving bobbins S reach an almost exhausted condition. And as mentioned above, another bobbin carriage holding a plurality of full packaged roving bobbins F in two alignments, which number of each alignment is identical to ½ of the total number of spindles at each side of the spinning frame, is displaced to the other creel position of the ring spinning frame, i.e., the above-mentioned bobbin carriage 9 having the full packaged roving bobbins F of two alignments is introduced to the supporting rail 6, as shown in FIG. 5.

Next, the clutch 42 of the supplemental feed roller 40 is released, and synchronously the brake 42*a* is actuated, and the following operation is carried out successively at all draft parts 30 of the spinning frame, that is, a supplemental roving S2 is taken from the corresponding full packaged roving bobbin F, and then a free end portion of the roving S2 is introduced to the roving guide bar 23 so that the free end portion of the roving S2 is temporarily hung on the roving guide bar 23.

The above-mentioned free end portion of the roving S2 is inserted to an intervening space 55*a* between the nip roller 44*b* and the supplemental feed roller 40 via a roving guide intervening space 55*b*, immediately after the lever 43 of the top arm 38 is turned upward about the axial center thereof to thereby separate the nip rollers 44*a* and 44*b* from the supplemental feed roller 40, so that the free end of the supplemental roving S2 is introduced to a position inside the trumpet 39 in a condition such that the free end of the roving S2 is close to the running roving S1, and thereafter, the lever 43 is turned back to the normal position at which the nip rollers 44*a* and 44*b* are in rotatable contact with the supplemental feed roller 40. According to the above-mentioned operation, the supplemental roving S2 is gripped by the nip roller 44*b* and the supplemental feed roller 40 which is held stationary (FIG. 3). The above-mentioned operation is carried out to all draft parts 30 at each side of the spinning frame.

Under the above-mentioned condition, the normal spinning operation is continuously carried out, and when all of the roving bobbins S of the bobbin carriage 9 supported by the supporting rail 5 reach an almost exhausted condition, the clutch 42 is reconnected synchronously release the action of the brake 42*a* during a period in which the size of all of the yarn packages of the ring spinning frame becomes between 30% to 90% of the full size yarn package. According to the above-mentioned operation of the clutch 42, and the brake 42*a*, the rotation of the supplemental feed roller 40 is started at the same surface rotation speed as that of the back roller 34, so that the supplemental roving S2 maintained at the standby position in the trumpet 39 of each draft part 30, is carried to the running position of the roving S1, and accordingly, the roving S2 is fed to the back roller 34 of each draft part synchronously in a doubled condition with the roving S1, so that the supplemental roving S2 is introduced to the back roller 34 of each draft part 30. Therefore, a joint piecing of the rovings is carried out synchronously at the all draft parts 30 concerned at each side of the ring spinning frame.

Immediately after or synchronously with the above-mentioned synchronous joint piecing operation, the piston rod 52*a* of the reciprocal cylinder 52 is actuated to project outwards as shown in FIG. 2, so that the roving guide member 51 is displaced in a direction identical to the projected direction of the piston rod 52*a* (right-hand direction in FIG. 2). Due to the motion of the piston rod 52*a*, in each draft part, the roving S1 and the supplemental roving S2 are displaced toward the above-mentioned direction, by the guide pins 51*b*, 51*c* and 51*d* respectively, so that the roving S1 is displaced to a position at which the roving S1 is passed through the nip point between the nip roller 44*a* and the supplemental roving feed roller 40. On the other hand, the free end portion of the supplemental roving S2, which was doubled with the running roving S1 by the above-mentioned joint piecing operation, is displaced to the intervening space between the supporting shaft 44 and an intervening portion of the supplemental roving feed roller 40 between the nip rollers 44*a* and 44*b*, from the condition of gripping the free end portion of supplemental roving S2 between the nip roller 44*b* and the supplemental roving feed roller 40. Immediately after the above-mentioned operation, the clutch 42 is actuated to stop the transmission of power and the brake 42*a* is actuated to instantly stop the rotation of the supplemental roving feed roller 40. Therefore the rovings S1 from the almost exhausted roving bobbins S are synchronously cut in a condition such that the rovings S1 are still gripped by the corresponding nip roller 44*a* and the supplemental roving feed roller 40. In other words, all of the rovings S1 from the almost exhausted roving bobbins S of the bobbin carriage 9 supported by the supporting rail 5, are synchronously cut at the respective positions close upstream of the supplemental feed roller 40, respectively.

After the above-mentioned cutting operation of the rovings S1, the lever 43 is turned upward about the axial center of the supporting shaft 43*a* mounted on each top arm 38, so that the grip to the roving S1 by the respective nip roller 44*a* and the supplemental roving feed roller 40 are released, and thereafter, the rovings S1 connected to the almost exhausted roving bobbins S are successively rewound by the corresponding roving bobbin S of the bobbin carriage 9 supported by the supporting rail 5, with respect to all draft parts 30 concerned.

After completion of the above-mentioned rewinding of the roving S1 by the almost exhausted roving bobbin S1 with respect to all draft parts 30 to which the synchronous roving piecing operation is carried out, the bobbin carriage 9 supporting the almost exhausted roving bobbins S is displaced from the supporting rail 5 to the roving room, and a bobbin carriage supporting full packaged roving bobbins F is introduced to the supporting rail 5 from which the bobbin carriage having the almost exhausted roving bobbins S has been discharged.

In the next synchronous roving piecing operation applied to all draft parts of each side of the ring spinning frame, since the full packaged roving bobbins F are going to almost exhausted condition, the operation identical to the operation mentioned above is applied to all draft parts aligned at each side of the spinning frame, with respect to the roving bobbins which are changed from the above-mentioned full packaged roving bobbins F supported by the supporting rail 6 and the full packaged roving bobbins of a bobbin carriages 9 which are introduced to the supporting rail 5 of the ring spinning frame. This operation is started from a condition such that the rovings F2 are nipped between the respective nip rollers 44*a* and the supplemental roving feed roller 40. As mentioned above, the above-mentioned two successive synchronous roving piecing operations are combined and such combined operations are successively repeated during the spinning operation.

Since the roving piecing operation is carried out synchronously as mentioned above, the operation can be carried out regardless of the time required for completing the formation of full yarn packages, and of the number of spindles, and since the roving piecing operation according to the present invention is carried out under a preferable condition such that the ring rail is located at the uppermost position in the chase formation, wherein the ballooning is very small, possible yarn breakages can be easily prevented.

The second embodiment of the present invention is hereinafter explained with reference to FIGS. 9, 10, 11 and 12. As shown in these drawings, three supporting rails 5*a*, 5*b* and 5*c* are provided at each side of the ring spinning frame, and these supporting rails 5*a*, 5*b* and 5*c* are provided with functions such that a bobbin carriage 9 having a plurality of bobbin hangers, a number of which is ½ of the total number of spindles arranged on each side of the spinning frame, is displacably supported. During the spinning operation, two of these supporting rails 5*a*, 5*b*, and 5*c* continuously support the bobbin carriage 9 supplying rovings to the corresponding spindles, and the remaining one of these supporting rails 5*a*, 5*b*, and 5*c* supports a bobbin carriage on which the full packaged roving bobbins are suspended, or a bobbin carriage by which almost exhausted roving bobbins are suspended. Therefore, the functions of these three supporting rails 5*a*, 5*b*, and 5*c* are stepwisely changed so as to carry out the supply of rovings to the respective draft parts concerned of each side of the spinning frame. As mentioned above, each one of the supporting rails 5*a*, 5*b* and 5*c* is utilized to support single bobbin carriage 9 provided with the bobbin hangers the number of which is identical to ½ of all spindles of each side of the spinning frame, and the spinning operation of the ring spinning frame is carried out by feeding rovings from the respective roving bobbins of two bobbin carriages 9 which are supported by either pair of the above-mentioned three supporting rails 5*a*, 5*b* and 5*c*. Under the above-mentioned condition, the so-called two-step taper arrangement of roving bobbins is applied. That is, before starting the spinning operation, full packaged roving bobbins are arranged at the respective positions of either one of the front alignment and rear alignment of the bobbin hangers in the creel portion of the each side of the spinning frame so that the rovings from these full packaged roving bobbins are ready to be supplied to the corresponding draft parts. While half exhausted roving bobbins are arranged at the respective positions of the other alignment of the bobbin hangers with respect to the above-mentioned alignment of the bobbin hangers holding the full packaged roving bobbins, and the roving from these half exhausted roving bobbins are ready to be supplied to the corresponding draft parts which are the remaining draft parts from the above-mentioned draft parts of the identical side of the spinning frame. In other words, a bobbin carriage 9 supporting half exhausted roving bobbins and a bobbin carriage supporting full packaged roving bobbins are introduced to either pair of three supporting rails 5*a*, 5*b* and 5*c*. For the sake of better understanding of the roving piecing operation, these bobbin carriages 9 are hereinafter referred to as a first mentioned bobbin carriage and a second mentioned bobbin carriage respectively.

In the normal practice of applying two-step taper arrangement of roving bobbins, the rovings from the roving bobbins of the rear alignment in the creel portion are supplied to the respective draft parts which consist of a group of alternate draft parts of the alignment of all draft parts at each side of the spinning frame, while the rovings from the roving bobbins of the front alignment in the creel portion are supplied to the respective draft parts which consist of a group of remaining alternate draft parts of the alignment of all draft parts at an identical side of the spinning frame. Therefore, the second embodiment of the present invention applies the above-mentioned roving supplying system to the draft parts.

After the above-mentioned preparation is completed, the spinning operation is then started. When the above-mentioned half exhausted roving bobbins become almost exhausted, the above-mentioned full packaged roving bobbins become substantially half exhausted, respectively. In such a condition, the operation of exchanging roving bobbins between the almost exhausted roving bobbins and the full packaged roving bobbins is required.

During the spinning operation until the half exhausted roving bobbins of the first mentioned bobbin carriage 9 become almost exhausted, a bobbin carriage suspending full packaged roving bobbins by the bobbin hangers thereof is introduced to one of three supporting rails 5*a*, 5*b* and 5*c*, which is a remaining supporting rail in addition to a pair of supporting rails 5*a* and 5*b*, or 5*b* and 5*c*, or 5*c* and 5*a*, which support the first mentioned and second mentioned bobbin carriages 9. The above-mentioned bobbin carriage 9 is hereinafter referred to as a third mentioned bobbin carriage. Therefore, when the roving bobbins (S) of bobbin carriages 9 supported by two of three supporting rails 5*a*, 5*b*, and 5*c*, which are supplying rovings to the respective draft parts 30, reach an almost exhausted condition, the rovings from full packaged roving bobbins (F) of the third mentioned bobbin carriage 9 are successively pieced with the corresponding roving S1 from the almost exhausted roving bobbins S of the first mentioned bobbin carriage 9, while the feeding of the rovings from the roving bobbins of the second mentioned bobbin carriage 9 to the corresponding draft parts is continuously carried out.

As mentioned above, since in the first embodiment of the present invention, the draft parts of each side of the ring spinning frame consist of a first group of draft parts to which the rovings are fed from the roving bobbins of the first mentioned bobbin carriage 9 and a second group of draft parts to which the rovings are fed from the roving bobbins of the second mentioned bobbin carriage 9, the synchronous roving piecing operation according to the present invention is alternately and separately applied to each of the above-mentioned two groups of the draft parts arranged at each side of the ring spinning frame, each time the condition is created that roving bobbins of either one of the above-mentioned two bobbin carriages 9 become almost exhausted.

Figure 10:
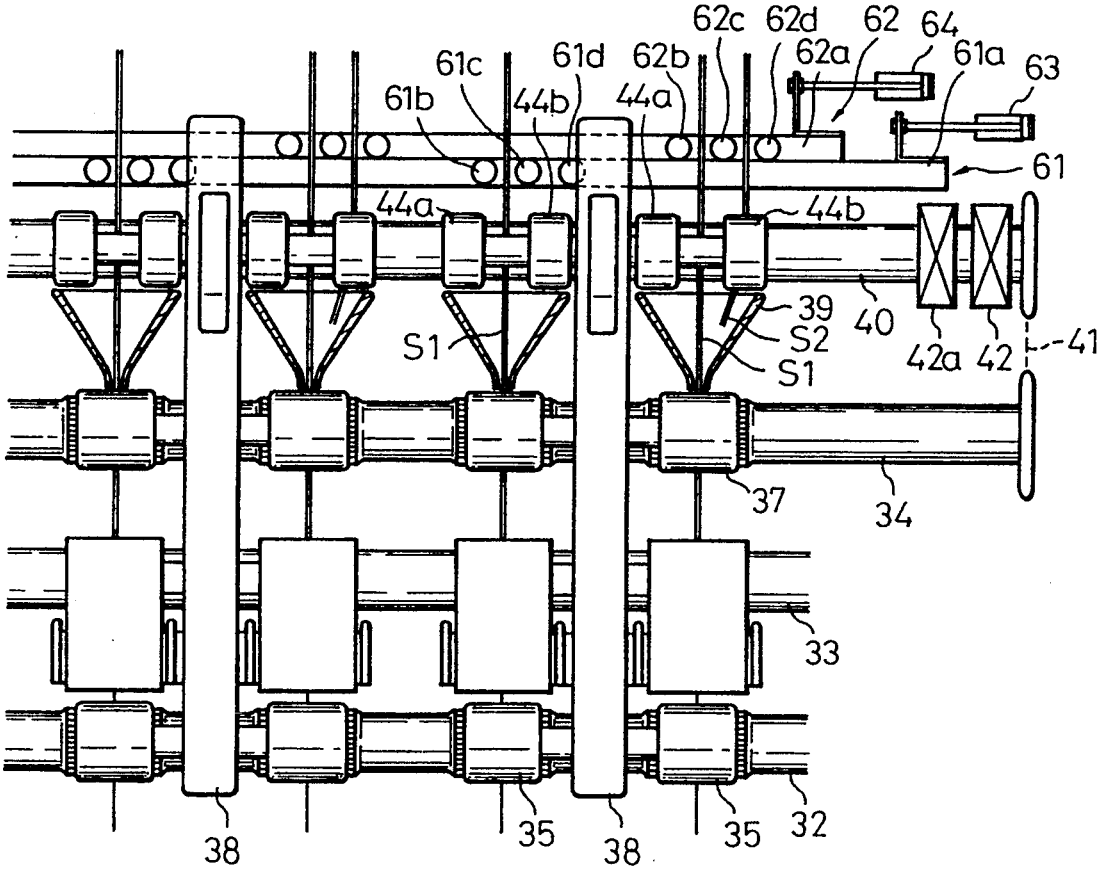
FIG. 10 is a plan view of a plurality of draft parts of a ring spinning frame to which the second embodiment of the present invention is applied.

As shown in FIG. 10, a pair of roving guide members 61 and 62 are disposed at respective positions behind the supplemental roving feed roller 40 in a condition such that they can be displaced along the lengthwise direction of the spinning frame. In this embodiment, instead of utilizing a spindle guide element such as the element 51 in the first embodiment, a pair of roving guide members 61 and 62 are utilized, and a plurality of groups of three guide pins 61*b*, 61*c* and 61*d* project outwardly from the respective positions of the roving guide members 61, and a plurality of three guide pins 62*b*, 62*c*, and 62*d* project outwardly from to the roving guide member 62.

The roving guide members 61 and 62 are capable of being displaced axially along the lengthwise direction of the spinning frame by the action of the reciprocal pneumatic cylinders 63 and 64 respectively, as in the first embodiment. To simplify the explanation of the second embodiment, machine elements having the same function as the machine elements of the first embodiment are identified by the same reference numerals as used in FIG. 10.

Figure 9:
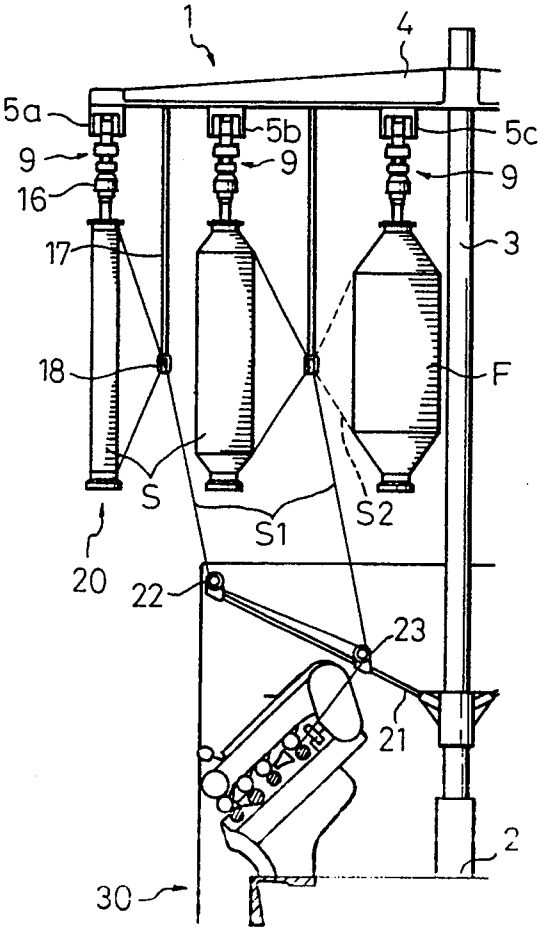
FIG. 9 is a side view of the ring spinning frame to which the second embodiment of the present invention is applied.
Figure 8:
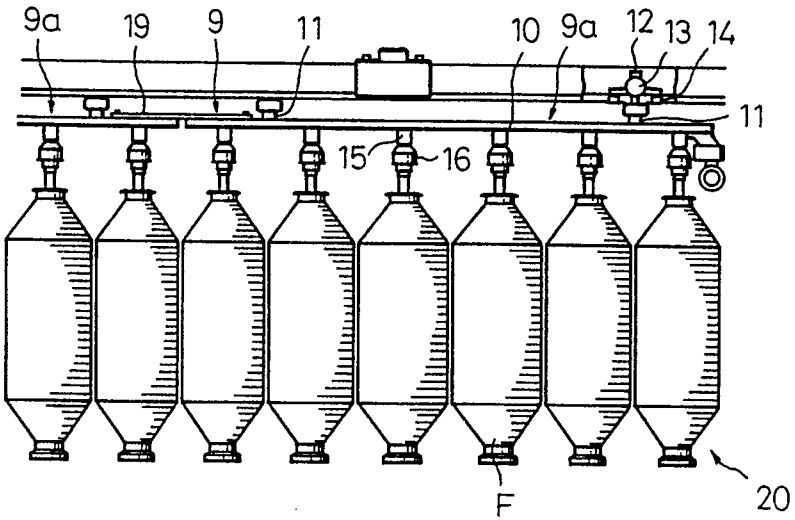
FIG. 8 is a side view of a bobbin carriage utilized to carry out the present invention.

Referring to FIGS. 9 and 10, the supporting rails 5*a* and 5*b* support the respective bobbin carriage 9 holding the roving bobbins S for feeding rovings to the corresponding draft parts 30 of the spinning frame. The successive roving piecing operation applied to the almost exhausted roving bobbins S of the bobbin carriage 9 supported by the supporting rail 5*a* and the full packaged roving bobbins F of the bobbin carriage 9 supported by the supporting rail 5*c* is hereinafter explained in detail. When the spinning operation is started after arranging a pair of bobbin carriages 9 suspending the full packaged roving bobbins and the half exhausted roving bobbins as mentioned above, the plural groups of guide members 61*b*, 61*c* introduce rovings S1 from the half exhausted roving bobbins, suspended by the first mentioned bobbin carriage 9, to corresponding draft parts 30, while plural groups of guide members 62*b*, 62*c* introduce rovings from the full packaged roving bobbins, suspended by the second mentioned bobbin carriage 9, to the corresponding draft parts 30 at each side of the spinning frame. And, during the period between the time of starting of the spinning operation and the time when the above-mentioned half exhausted roving bobbins become almost exhausted, roving S2 from the full packaged roving bobbins suspended by the third mentioned bobbin carriage 9 are introduced to the respective positions close to the corresponding rovings S1 in the trumpets 39 of the corresponding draft parts respectively in almost the manner as in the first embodiment, and then free end portions of the supplemental rovings S2 are nipped by the nip roller 44*b* and the supplemental roving feed roller 40 at the respective positions upstream of the corresponding draft parts 30. In this condition, the free end portion of the above-mentioned supplemental roving S2 takes a position very close to the roving S1, which is supplied to the corresponding draft part 30 in the trumpet 39 thereof, and the rovings 61 and 62 take a position controlled by the roving guide member 62 as shown in FIG. 10.

When the roving bobbins S of the bobbin carriage 9 supported by the supporting rail 5*a* reach an almost exhausted condition, the following synchronous roving piecing operation is started in a preferable condition such that the ring rail of the spinning frame takes a position close to the uppermost position in the chase formation. As in the first embodiment, the synchronous roving piecing operation is carried out during a period in which the size of the yarn package becomes 30% of the full size yarn package and the size of the yarn package becomes 90% of the full yarn package.

Figure 11:
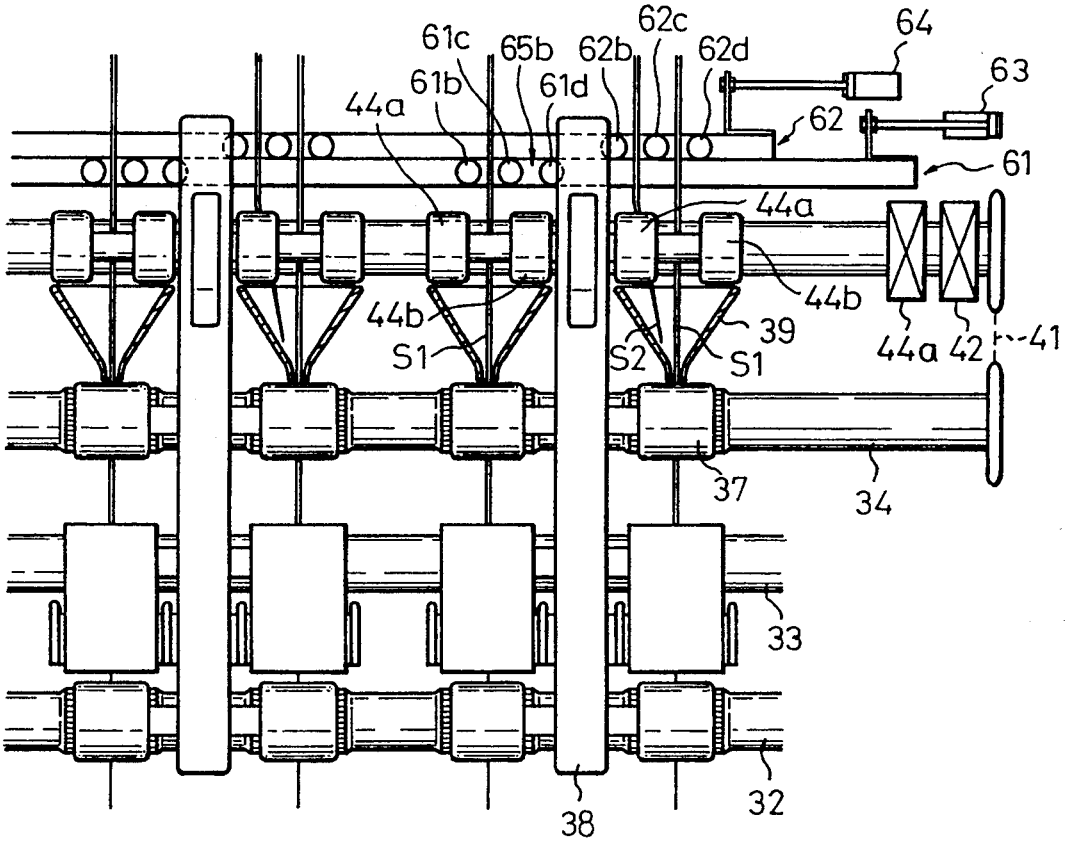
FIG. 11 is a plan view of a plurality of draft parts of the ring spinning frame shown in FIG. 10, and shows the condition wherein the synchronous roving piecing operation is completed according to the present invention.
Figure 12:
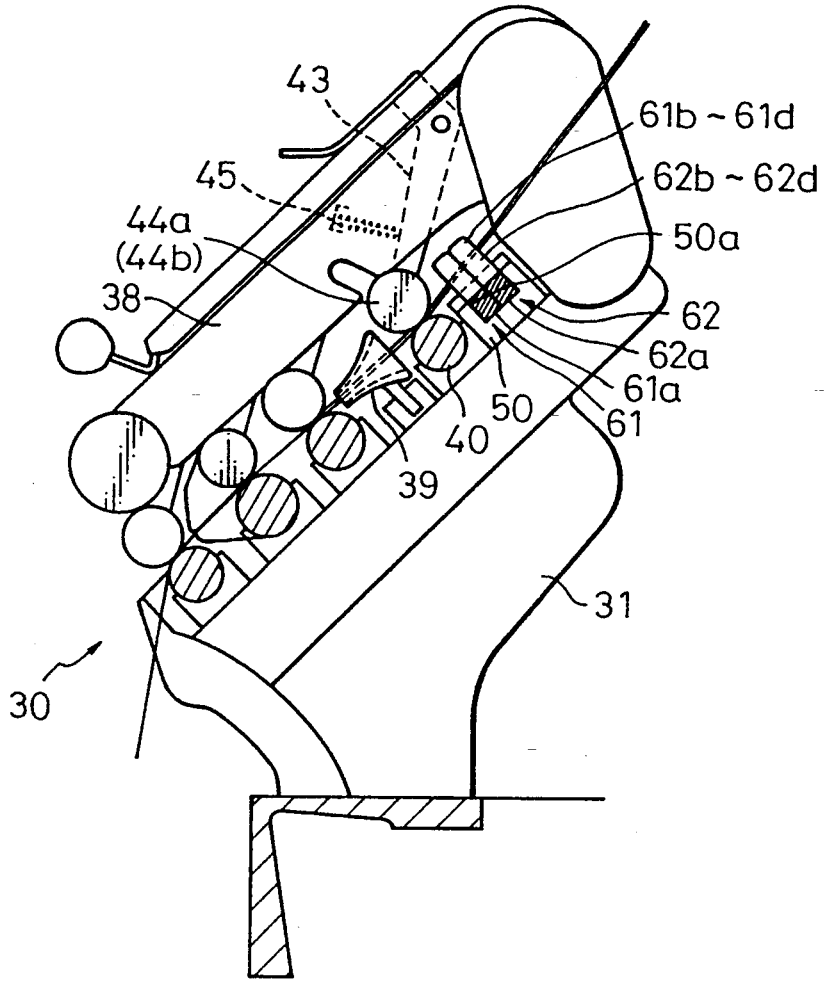
FIG. 12 is a side sectional view of the draft parts of the ring spinning frame shown in FIG. 10.

The synchronous roving piecing operation is carried out as follows: First, the clutch 42 is connected and synchronously, the action of the brake 42*a* is released so that the rotation of the supplemental roving feed roller 40 is started at a surface rotation speed identical to that of the back roller 34. According to this operation, the free end of the supplemental roving S2 is doubled with the roving S1 supplied and introduced into the corresponding draft part 30, whereby the joint piecing of two rovings S1 and S2 is performed. The roving guide member 62 is displaced only for a predetermined distance along the lengthwise direction of the spinning frame (in FIG. 11, left-hand side) so that the roving S1 is nipped by the roller 44*a* and the roller 40 while the supplemental roving S2 is released from the nip roller 44*b* and the roller 40. Thereafter, the clutch 42 is disconnected and the brake 42*a* is actuated, and the rovings S1 which are supplied from the almost exhausted roving bobbins S of the bobbin carriage 5*a* are synchronously cut as shown in FIG. 11. Since the two-step taper arrangement of roving bobbins is applied to the second embodiment of the present invention, the above-mentioned synchronous roving piecing operation, which is referred to as a unit roving piecing operation, is applied to either one of the above-mentioned two groups of the draft parts at each side of the spinning frame, alternately. As in the first embodiment, the cut rovings S1 connected to the respective roving bobbins S, which are created by the above-mentioned synchronous operation, are rewound on the corresponding almost exhausted roving bobbins S and then the bobbin carriage 9 holding these almost exhausted roving bobbins S is discharged from the transporting rail of the spinning frame and a fresh bobbin carriage 9 holding full packaged roving bobbins F is introduced to the transporting rail to replace the above-mentioned bobbin carriage 9 discharged therefrom.

Next, the unit roving piecing operation applied to the condition shown in FIG. 9 is explained in detail with reference to FIGS. 9, 10 and 11.

During the above-mentioned desirable period for carrying out the synchronous roving piecing operation according to the present invention, the rovings S2 from the above-mentioned fresh full packaged roving bobbins F, suspended by the third mentioned bobbin carriage 9 of the supporting rail 5*c*, are introduced to the respective trumpets 39 of the corresponding draft parts 30 which belong to a group of draft parts receiving rovings from the roving bobbins suspended by the first mentioned bobbin carriage 9. Each of these draft parts 30 are positioned at the right side of the corresponding top arm 38 as shown in FIG. 10, by passing through the respective roving guide intervening spaces 65*b* formed between each pair of guide pins 61*c* and 61*d* of the roving guide member 61, while the free end of each roving S2 is nipped by the corresponding nip roller 44*b* and the supplemental roving guide roller 40. In this condition, the roving S2 and the roving S1 are regulated in the respective positions by the roving guide member 62.

When the roving bobbins suspended by the first mentioned bobbin carriage 9 become almost exhausted wherein it is suitable to carry out the synchronous roving piecing operation, the clutch 42 is engaged and the action of the brake 42*a* is simultaneously released, and the supplemental feed roller 40 is also synchronously rotated by an identical circumferential speed thereof, so that the joint piecing between the roving S1 and S2 is created like the above-mentioned first embodiment, while the roving guide member 62 is only displaced for a predetermined distance along the lengthwise direction thereof, so accordingly, the roving S1 is nipped by the nip roller 44*a* and the supplemental feed roller 40, while the nipping action by the nip roller 44*b* and the supplemental nip roller 40 is released, and when the clutch 42 is actuated to disconnect the power transmission from the driving system 41 to the supplemental feed roller 40, the slivers S1 are synchronously cut. This condition is shown in FIG. 11. Thereafter, the remaining cut rovings are rewound by the respective roving bobbins suspended by the first mentioned bobbin carriage 9 and this bobbin carriage 9 is discharged from the supporting rail 5*a* and a fresh bobbin carriage 9 suspending full packaged roving bobbins is introduced onto the supporting rail 5*a*. Thereafter, the rovings from the full packaged roving bobbins of the fresh bobbin carriage 9 supported by the supported rail 5*a* are introduced to the respective intervening gap 65*b* between a corresponding combination of the guide pins 61*c* and 61*d* and nipped by the respective nip rollers 44*b* and the supplemental nip roller 40, respectively. As indicated in FIG. 11, the above-mentioned intervening gaps 65*b* are positioned at the respective positions at the left side of the corresponding top arm 38. And the next unit synchronous roving piecing operation is applied to the above-mentioned roving from the full packaged roving bobbin suspended by the bobbin carriage 9 supported by the supporting rail 5*a* and the rovings from the roving bobbins suspended by the second mentioned bobbin carriage 9 when the roving bobbins of the second-mentioned bobbin carriage 9 become almost exhausted. And in this synchronous roving piecing operation, the roving guide member 61 is only displaced for a predetermined distance towards a left-side lengthwise direction.

Figure 14:
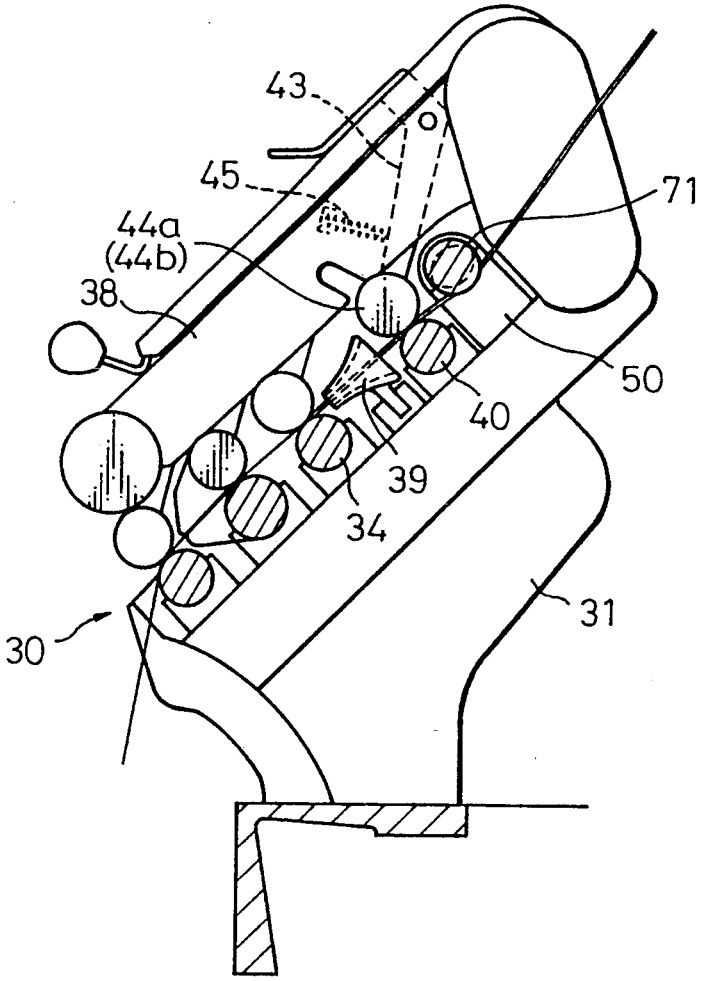
FIG. 14 is a side sectional view of the draft parts of the ring spinning frame shown in FIG. 13.
Figure 15:
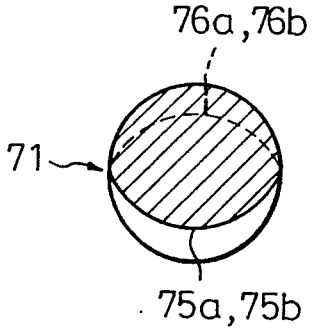
FIG. 15 is an enlarged sectional view of a line shaft utilized in the apparatus shown in FIG. 14.

The third embodiment of the present invention, which is a modification of the second embodiment, is explained with reference to FIGS. 13, 14 and 15.

Figure 13:
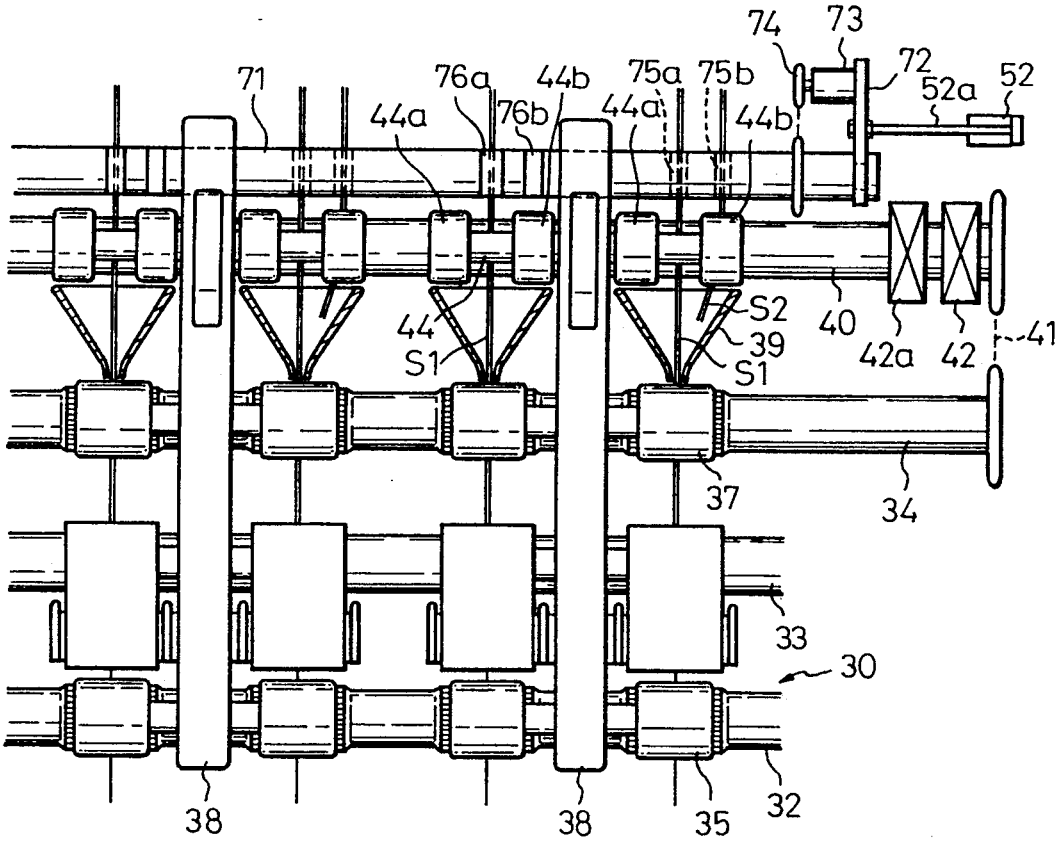
FIG. 13 is a view of a plurality of draft parts of a ring spinning frame to which the third embodiment of the present invention is applied.

As is clear from the drawing of FIG. 13, the construction of the apparatus of the third embodiment differs from the second embodiment only in the construction of the roving guide member. That is, in the third embodiment, a single roving guide member formed by a line shaft 71 is extended for the entire length of the spindle alignment of the ring spinning frame, instead of utilizing a pair of roving guide members 61 and 62 as in the second embodiment. The line shaft 71 is mounted on the spinning frame in a condition such that the line shaft 71 is able to rotate about the axis thereof, and able to slide along the axis thereof. One end of the line shaft 71 is rotatably supported by a shift-plate 72 as shown in FIG. 13. The shift-plate 72 is connected to a piston rod 52*a* of a pneumatic cylinder 52, a motor 73 is rigidly mounted on the shift-plate 72, and the line shaft 71 is rotated by 180 degrees once, by a suitable power transmission system such as an endless chain driving system, when the motor 73 is actuated.

The line shaft 71 is provided with two groups of guide means, one group consisting of a pair of guide grooves 75*a* and 75*b*, and the other group consisting of a pair of guide groups 76*a* and 76*b*. The pairs of guide grooves belonging to one group and the pairs of guide grooves belonging to the other group are alternately formed in the line shaft, and these first pairs of grooves 75*a*, 75*b*, and the second pairs of grooves 76*a*, 76*b*, are formed in the line shaft 71 in a condition such that the angular phase difference between the first pairs of grooves 75*a*, 75*b* and the second pairs of grooves 76*a*, 76*b* is 180 degrees, as shown in FIG. 15. Further, the above-mentioned arrangement of the first pairs of grooves 75*a*, 75*b* and the second pairs of grooves 76*a*, 76*b* is such that, when the first pair of guide grooves 75*a*, 75*b* face one of the corresponding nip rollers 44*a*, 44*b*, the second pair of guide grooves 76*a*, 76*b* face the respective intervening positions between the corresponding pairs of the nip rollers 44*a* and 44*b*.

In this embodiment, each roving S1 from the corresponding roving bobbin S is introduced to the trumpet 39 of the corresponding draft part 30 after passing a position below the line shaft 71. Under the above-mentioned condition, the rovings S1 passes through the roving guide groove 75*a*, which is facing downwards, to the corresponding draft part 30 as shown in FIG. 13.

Before carrying out the synchronous roving piecing operation, the supplemental rovings S2 are taken from the full packaged roving bobbins F and then introduced to the respective nip rollers 44b of the corresponding draft parts 30, and the free end portions of the supplemental rovings F are nipped between the nip roller 44b of the corresponding draft part 30 and the supplemental roving feed roller 40.

When the synchronous roving piecing operation is started at a preferable time mentioned in the explanation of the previous embodiment, the supplemental rovings S2 are supplied to the corresponding draft parts 30 by rotating the supplemental roving feed roller 40 by the operation of the clutch 42 and the brake 42a. The line shaft 71 is synchronously displaced toward the direction of the nip rollers 44a (left-hand side in FIG. 13) so that the supplied roving S1 is nipped by the nip roller 44a of the corresponding draft part 30 and the supplemental roving feed roller 40, while the supplemental roving S2 is released from the nipping action by the nip roller 44b of the corresponding draft part 30 and the supplemental roving feed roller 40. Accordingly in the above-mentioned operation, the joint piecing of the roving S2 with the roving S1 is carried out synchronously in the draft parts 30 which are alternate draft parts of the alignment of the draft parts 30 at each side of the ring spinning frame. Thereafter, the rovings S1 connected to the respective almost exhausted roving S are synchronously cut by the action of the clutch 42 and the brake 42a, as described in the second embodiment and thereafter, these rovings S1 are rewound on the corresponding almost exhausted roving bobbins S of the bobbin carriage 9 supported by the supporting rail 5a, and this bobbin carriage 9 is discharged from the supporting rail 5a. Then, a fresh bobbin carriage 9 holding the full packaged roving bobbins F is carried to the supporting rail 5a. During the above-mentioned synchronous roving piecing operation, with respect to the draft parts 30 to which the synchronous roving piecing operation is not applied, since the roving guide grooves 76a and 76b are in the respective positions facing upward, the rovings S1 which are supplied to the corresponding draft parts are not displaced towards the nip roller 44a of each draft part 30, but are introduced into the corresponding guide groove 76a of each draft part 30, where the roving guide groove 76a faces the nip roller 44a of each corresponding draft part 30.

When the above-mentioned other rovings S1, which are not subjected to the above-mentioned synchronous roving piecing operations, are subjected to the synchronous roving piecing operation, the motor 73 is actuated so that the line shaft 71 is turned by 180 degrees, and accordingly, the positions of the pairs of the roving guide grooves 76a and 76b, which are facing the other rovings S1, are changed to the respective positions facing downward, and accordingly, the another rovings S1 are introduced into the corresponding roving guide grooves 76b. Under the above-mentioned condition, the supplemental rovings S2 taken from the full packaged roving bobbins F of the bobbin carriage 9 supported by the supporting rail 5a are introduced to the respective positions close to the proximity to the corresponding nip rollers 44a respectively, by way of the corresponding roving guide grooves 76a facing the respective nip rollers 44a, and then nipped by the corresponding nip rollers 44a and the supplemental roving feed roller 40, and the synchronous roving piecing operation is carried out after displacing the line shaft 71 towards the direction opposite to the direction of the previous synchronous roving piecing operation (right-hand side in FIG. 13).

Figure 16:
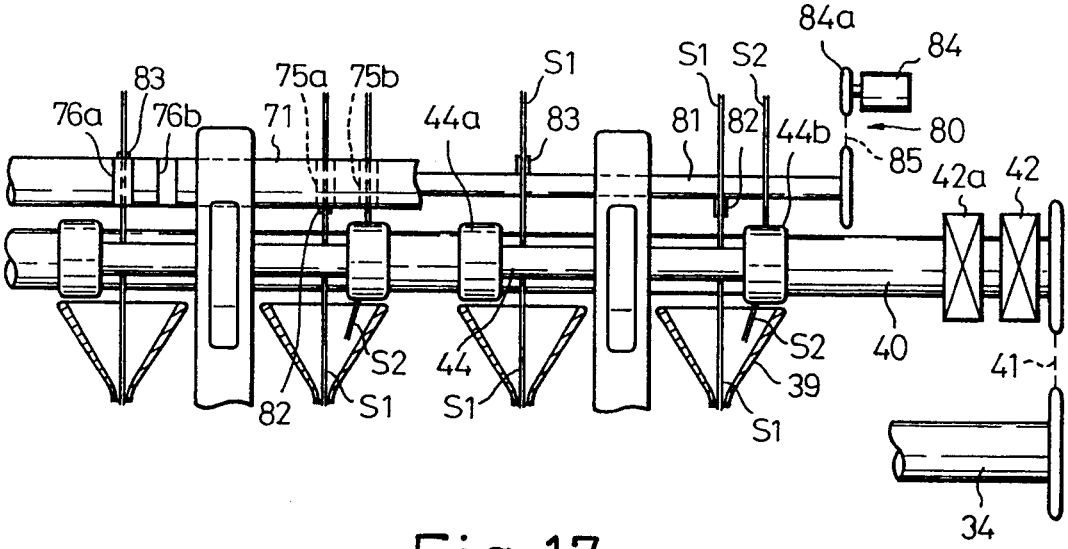
FIG. 16 is a plan view of a plurality of draft parts, partly in section and with parts omitted, of a ring spinning frame to which the fourth embodiment of the present invention is applied.
Figure 17:
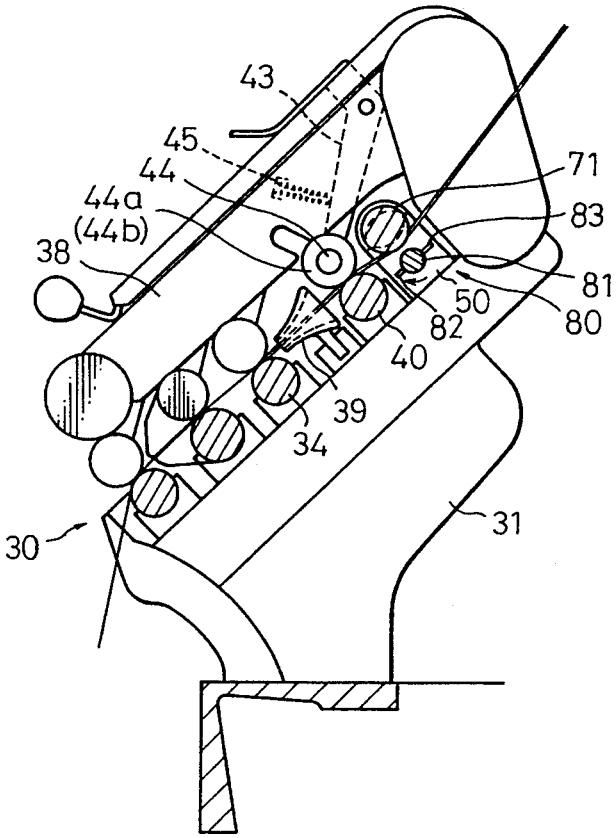
FIG. 17 is a sectional view of the draft parts of the ring spinning frame shown in FIG. 16.

The fourth embodiment of the present invention is hereinafter explained in detail with reference to FIGS. 16, 17, and 18. In this embodiment, the roving S1, which are supplied from the respective almost exhausted roving bobbins S1, are synchronously cut by a cutting means at the respective positions upstream of the respective draft parts, and the supplemental roving S2 are synchronously supplied to the corresponding draft parts together with the roving S1 which are separated from the respective roving S1 connected to the corresponding roving bobbins S after the above-mentioned cutting operation or synchronously therewith, to carry out the above-mentioned cutting operation. In the apparatus of the fourth embodiment of the present invention, one of the nip rollers 44a and 44b is omitted in each combination of these nip rollers 44a and 44b, for example, the nip rollers 44a and 44b taking respective positions close to the top arm 38 are omitted as shown in FIG. 16, and the means for synchronously cutting the rovings S1, which are supplied from the respective roving bobbins S, are additionally utilized. That is, the roving cutting means 80 comprises a line shaft 71 supported by a supporting member 50 at a position upstream of the supplemental feed roller 40, and a cutting shaft 81 which is rotatably supported by the supporting member 50 in parallel to the line shaft 71, at a position below the shaft 71. The shaft 71 is able to rotate about the axial center thereof and is able to be synchronously displaced along the axial direction thereof. The line shaft 71 is provided with roving guide grooves 75a for guiding rovings S, which are supplied from the respective roving bobbins S, to the group of draft parts 30 which are alternate draft parts 30 of the alignment of the draft parts 30 at each side of the spinning frame, and with roving guide grooves 76a for guiding the rovings S1 to the group of the draft parts 30 which are other alternate draft parts 30 of the alignment of the draft parts 30, and these roving guide grooves 75a and the roving guide grooves 76a are formed in a condition such that the angular phase difference between each roving guide groove 75a and each roving guide groove 76a is 180 degrees about the axial center of the line shaft 71. The cutting shaft 81 is provided with a group of cutting members 82, which are planted on the cutting shaft 81 vertical to the axis thereof, and another group of cutting members 83 which are planted on the cutting shaft 81 vertical to the axis thereof. The cutting members 82 can be inserted to the corresponding roving guide grooves 75a respectively, and the cutting members 83 can be inserted into the corresponding roving guide grooves 76a respectively. One end portion of the cutting shaft 81 is connected to a shaft of a drive pulley 84a driven by a drive motor 84 rigidly mounted on a machine frame 2 of the spinning frame, by way of a drive system 85 such as an endless chain drive system, and the cutting shaft 81 is able to be turned 180 degrees about the axis thereof once when required. When the cutting members 82 or 83 are inserted to the corresponding roving guide groove 75a or 76b, respectively, the rovings, which are supplied from the respective almost exhausted roving bobbins S, are forcibly cut at the respective positions between the corresponding cutting members 82 or 83 and the line shaft 71.

In the above-mentioned embodiment, the rovings S1 are introduced to the respective trumpets 39 of the corresponding draft parts 30 after passing through the respective passages above the cutting shaft 81 and below the line shaft 71. In this condition, the rovings S1 are introduced into the respective roving grooves 75*a* of the line shaft 71, because these guide grooves 75*a* face downward. Since the cutting shaft 81 is able to be rotated in a direction which is opposite to the rotating direction of the back roller 34 of the draft parts 30, when the cutting members 82 (83) are inserted to the corresponding roving guide grooves 75*a* (76*a*) while turning, the rovings S1 can be easily cut by the cutting members 82 (83) and the corresponding roving guide grooves 75*a* (76*a*).

As in the above-mentioned three embodiments, the supplemental rovings S2 are taken from the respective full packaged roving bobbins F and introduced to the respective nip rollers 44*b* of the corresponding draft parts 30, and held there in a condition such that these supplemental roving S2 are nipped between the corresponding nip rollers 44*b* and the supplemental roving feeding shaft 40.

Figure 18:
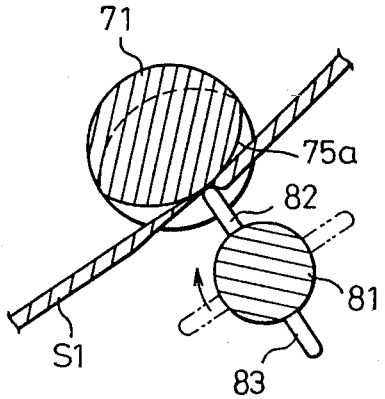
FIG. 18 is an explanatory view of the separating action applied to a sliver according to the fourth embodiment of the present invention.

When the synchronous roving piecing operation is required, the motor 84 is actuated automatically or by a manual operation of a switch, so that the cutting shaft 81 is turned by 180 degrees about the axis thereof toward the direction indicated by an arrow in FIG. 18. According to the above-mentioned operation, when the cutting members 82 are inserted to the corresponding roving guide grooves 75*a*, the rovings S1, which are supplied from the almost exhausted rovings of the bobbin carriage 9, are cut by gripping between the respective cutting members and the corresponding roving guide grooves 75*a*. Each roving S1, which is cut and continuously fed to the corresponding draft part 30 remains a certain length in the region upstream of the trumpet 39 of the corresponding draft part 30, and the above-mentioned remaining portion of the roving S1 is eliminated when this portion is introduced to the corresponding draft part 30. At a predetermined time, as described in the other embodiments, the clutch 42 is temporarily actuated to connect the component shafts thereof so that the supplemental rovings S2 are synchronously fed to the respective trumpets 39 of the corresponding draft parts 30. Due to this operation, since the supplemental rovings S2 are introduced into the respective back rollers 30 while doubled with the corresponding rovings S1, the line shaft 71 is synchronously displaced towards a direction along the axis thereof so that the supplemental rovings S2 are released from the nipping action by the corresponding nip roller 44 and the supplemental roving feed roller 40. The above-mentioned displacement of the line shaft 71 is carried out towards the left-hand side in FIG. 16. Due to the above-mentioned motion of the line shaft 71, the supplemental rovings S2 are continuously fed to the respective trumpets 39 of the corresponding draft parts 30 through the intervening space between the corresponding nip roller 44*b* and the top arm 38 thereof, so that the synchronous roving piecing operation applied to half the number of draft parts at each side of the spinning frame is completed. To carry out the synchronous roving piecing operation applied at the other half of the number of draft parts at each side of the spinning frame, the line shaft 71 is turned 180 degrees about the axis thereof so that the supplemental rovings S2 are nipped by the nip rollers 44*a* of each pair of nip rollers 44*a* and 44*b* and the supplemental roving feed roller 40. Before the operation of the synchronous roving piecing operation applied to the other draft parts 30, to which the previous synchronous roving piecing operation was not applied, is started, the supplemental rovings S2 are introduced to the respective nip rollers 44*a* of the corresponding draft parts 30 so that the supplemental rovings S2 are nipped by the respective nip rollers 44*a* of the corresponding draft parts 30 and the supplemental roving feed roller 40, respectively. When the synchronous roving piecing operation is carried out, the cutting roller 81 is turned by 180 degrees about the axis thereof, and the cutting members 83 are inserted to the respective roving guide grooves 76*b* facing the corresponding draft units 30 respectively, so that the rovings S1 from the respective roving bobbins S of the bobbin carriage 9 are respectively cut. Thereafter, the supplemental roving feed roller 40 is temporarily rotated by actuating the clutch 42 and the brake 42*a*, whereby the supplemental rovings S2 are synchronously introduced to the trumpets 39 of the corresponding draft parts 30, and the supplemental rovings S2 are released from the nipping action by the respective nip rollers 44*a* and the supplemental roving feed roller 40 by displacing the line shaft 71 in the direction towards the right-hand side in FIG. 16. The synchronous roving piecing operation applied to the other all draft parts concerned at each side of the roving frame is completed according to the above-mentioned stepped operation.

In the above described embodiment, the cutting means 80 comprising the cutting shaft 81 and the cutting members 82, 83 is utilized, but instead of the cutting means 80, a mechanism for separating rovings into two portions by applying a tensile force thereto can be applied.

Figure 19:
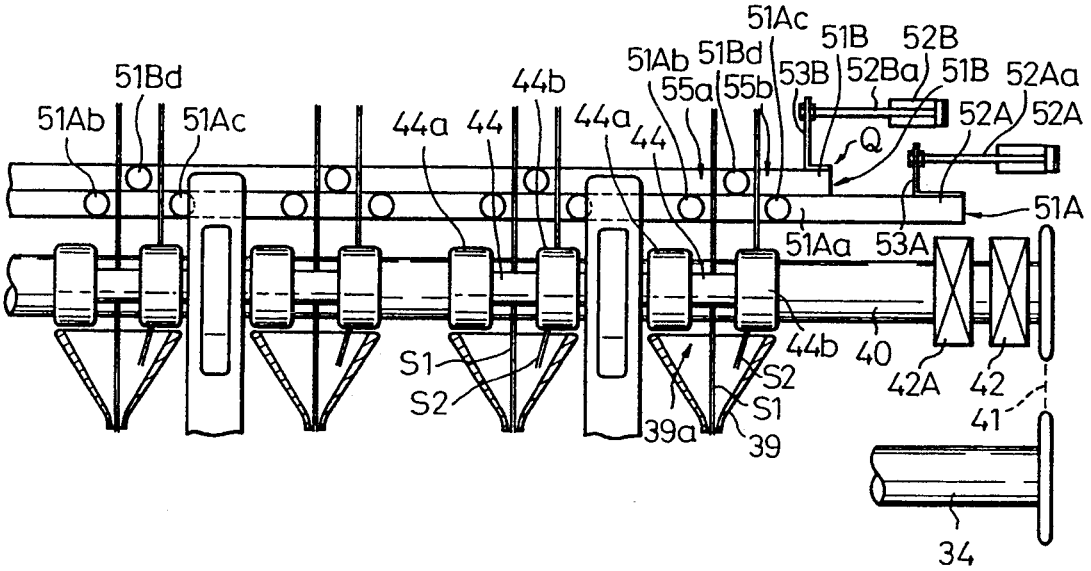
FIG. 19 is a plan view of a plurality of draft parts of a ring spinning frame to which a further modified means for carrying out the separation of a sliver according to the present invention is applied.

The other type of the roving cutting means is disclosed in FIG. 19. As shown in FIG. 19, a pair of roving guide rods 51A and 51B are mounted on the respective guide grooves (not shown) of supporting members (not shown) rigidly mounted on the roller stands 31, in a condition such that these rods 51A and 51B are reciprocally slidable along the lengthwise direction of the spinning frame. These roving guide rods 51A and 51B have a rectangular cross section.

The roving guide rod 51A extends along the entire length of the spindle alignment of each side of the spinning frame, and is provided with a plurality of pairs of guide pins 51Ab and 51Ac planted at positions facing each draft part 30, with a predetermined intervening space therebetween. The roving guide rod 51B also extends along the entire length of the spindle alignment at each side of the spinning frame, and a plurality of roving guide pins 51Bd are planted on the rod 51B facing each draft part 30.

The above-mentioned roving cutting means is provided with a function such that, when the roving guide rods 51Ab, 51Ac are relatively displaced along the lengthwise direction thereof and cause the guide pins 51Ab, 51Ac of the guide rod 51A to approach the corresponding guide pins 51Bd of the guide rod 51B, the rovings S1 which are supplied from the respective roving bobbins S of the bobbin carriage 9 supported by the supporting rail 5 (FIG. 9) are gripped by the corresponding guide pins 51Ab, 51Ac and the guide pins 51Bd of the corresponding draft parts 30, respectively. Accordingly, when the rod 51B is displaced in the left-hand direction in FIG. 19 for a distance corresponding to the intervening space between the pins 55*a* and 55*b*, each roving S1 is gripped by the respective pins 51Ab and the pins 51Bd, and thus the rovings S1, which are continuously introduced to the corresponding draft parts 30 by the continuous rotation of the draft rollers of each draft part, are separated from the gripped portion of the corresponding rovings S1.

In the first, second and third embodiments mentioned above, the following modification can be made. Namely, as a modification of the above embodiments, after the supplemental rovings S2 are introduced into the corresponding draft parts 30 respectively, together with the corresponding rovings S1, the spinning operation of the spinning frame is temporarily stopped and the rovings S1 are synchronously cut at the respective positions close upstream of the respective trumpets 39 of the corresponding draft parts 30, by a manual operation, and the spinning operation of the spinning frame is restarted after the completion of the manual operation. In the above modification, the spinning operation of the spinning frame can be automatically stopped by a signal indicating the most preferable time for stopping the drive of the spinning frame, or the drive of the spinning frame is topped by a manual switching. Therefore, in the above modification, the brake 42*a*, or the combination of the brake 42*a* and the roving cutting means 80 can be omitted.

The modification applied to the first, second and third embodiments mentioned above can be also applied to the fourth embodiment. That is, in this modification for cutting the rovings S1 which are supplied to the corresponding draft parts 30, the spinning operation of the spinning frame is temporarily stopped and the rovings S1 are successively cut at the respective positions upstream of the corresponding draft parts 30 by a manual operation, while the drive of the spinning frame is stopped, and after the completion of the above operation, the drive of the spinning frame is restarted so that the cut portions thereof, which remained at the side of the corresponding draft parts, are introduced to the corresponding draft parts. When the free ends of the above-mentioned portions of the rovings S1 approach the respective positions upstream of the trumpets 39 of the corresponding draft parts 30, the clutch 42 is actuated to introduce the respective supplemental rovings S2 into the corresponding draft parts 30 together with the corresponding free ends of the above-mentioned cut portions of the corresponding rovings S1, and after the free ends of the rovings S1 are completely introduced into the corresponding draft parts 30, the reciprocal pneumatic cylinder 52 is actuated so that the line shaft 71 is displaced towards the left hand side in FIG. 1, and consequently, the guide pins 51*b* displace the corresponding supplemental rovings S2 towards the left hand direction in FIG. 1 so that the supplemental rovings S2 are released from the nipping action by the corresponding nip rollers 44*a* and the supplemental feed roller 40. Thereafter, the clutch 42 is disconnected so that the rotation of the supplemental feed roller 40 is stopped. Accordingly, the modified synchronous roving piecing operation applied to all of the draft parts 30 concerned is completed.

As is clear from the above explanation, according to the present invention, the roving piecing operation at the time of changing almost exhausted roving bobbins for the full packaged roving bobbins can be carried out within a very short time due to the application of the synchronous roving piecing method according to the present invention. Therefore, the roving piecing operation can be completed during the formation of a chase in a condition such that the ring rail takes a position close to the uppermost position of each chase formation where the spinning condition is stable, whereby possible yarn breakages are effectively prevented.

Moreover, since the time required to complete the roving piecing operation when changing the almost exhausted roving bobbins for the full packaged roving bobbins can be remarkably reduced, i.e., the above roving bobbin exchange operation can be carried out within a remarkably shorter time than in the conventional method, the working efficiency of the spinning frame can be remarkably improved. This is very advantageous when producing a coarse yarn.

Further, in the synchronous roving piecing operation according to the present invention, the supplemental rovings S2 are taken from the respective full packaged roving bobbins F of a bobbin carriage supported by a transporting rail of the spinning frame and held at the respective positions close to the corresponding rovings S1, which are supplied to the corresponding draft parts 30, before the roving bobbins S reach an almost exhausted condition, and accordingly, the time necessary to complete the operation of taking the supplemental rovings S2 from the respective full packaged roving bobbins F and carrying out the roving piecing operation is variable, and thus the roving bobbin exchange operation can be carried out under very free conditions in comparison with the conventional method.

We claim:

1. A method of synchronously piecing rovings for carrying out a roving bobbin exchanging operation between second roving bobbins in an almost exhausted condition and corresponding full packaged first roving bobbins, in a ring spinning frame which is provided with (a) a plurality of spindles arranged with an identical spindle pitch in an alignment along a lengthwise direction of said spinning frame at each side thereof, (b) a creel portion, (c) a plurality of draft parts arranged along said alignment of spindles at a position between said creel portion and said spindle alignment, said draft parts being positioned in relation to respective spindles and perpendicular to the lengthwise direction of said spindle alignment; a roving bobbin transporting system for introducing bobbin carriages to said creel portion of said spinning frame and for discharging said bobbin carriages therefrom, wherein said roving exchange operation is carried out between said almost exhausted second roving bobbin of said bobbin carriage positioned at said creel portion of said ring spinning frame and corresponding ones of said full packaged first roving bobbins of another bobbin carriage carried to said creel portion of said spinning frame, said method comprising the steps of:

synchronously reserving a leading free end of a roving taken from each one of a plurality of full packaged first roving bobbins at a position in proximity to a roving being fed from a corresponding one of a plurality of second roving bobbins until said second roving bobbins become almost exhausted, said reserving being done in a region upstream of feeding said roving to a corresponding one of said draft parts, a step of synchronously cutting said rovings from said second roving bobbins, at corresponding upstream feeding positions of said draft parts, when said second roving bobbins reach an almost exhausted condition, so that tail ends of said rovings of said second roving bobbins are created;

synchronously feeding said reserved leading free end of a roving from said full packaged first roving bobbin together with said tail end portion of said roving from a corresponding one of said second roving bobbins, which is feeding to said draft part, in a doubled condition, at a time immediately before said tail end portion of said roving from said second roving bobbin is fed into said draft part;

thereby carrying out a synchronous piecing operation of said leading free end of said roving taken from said one of said full packaged first roving bobbins with said tail end portion of said roving from a corresponding one of said almost exhausted second roving bobbins.

2. A method according to claim 1, wherein said synchronous roving piecing operation is carried out at all draft parts of said alignment of draft parts at said each side of said spinning operation.

3. A method according to claim 1, wherein said roving piecing operation is synchronously carried out for either one of two groups of draft parts, one said group consisting of all odd numbered draft parts counted from an end of said spinning frame and another one of said two groups consisting of all even numbered draft parts counted from said end of said spinning frame, alternately, wherein when said synchronous roving piecing operation is applied to a first one of said two groups of draft parts, a size of roving bobbins which feed a second one of said two groups of draft parts is almost half exhausted.

4. A method according to claim 1, wherein said synchronous feeding of said reserved free leading end of a roving from said full packaged first roving bobbin together with said tail end of said roving from a corresponding one of said second roving bobbins is carried out immediately after cutting said roving from said second roving bobbin so as to create said tail end with said roving from said same second roving bobbin.

5. A method according to claim 1, wherein said synchronous feeding of said reserved free end of a roving from said full packaged first roving bobbin together with said roving from a corresponding one of said second roving bobbins is carried out by (i) feeding said reserved leading free end of a roving from each of said full packaged first roving bobbins with said roving from a corresponding one of said second roving bobbins, when said second roving bobbin becomes almost exhausted, and (ii) cutting said rovings from said second roving bobbin at a time when said tail end of each of said second roving bobbins is created at a time substantially identical to a time when said leading free end portion of said roving from each one of said first roving bobbins reaches to corresponding draft part.

6. A method according to claim 1, wherein said roving piecing operation is synchronously carried out for all of said draft parts arranged along said alignment of spindles arranged along lengthwise direction of said spinning frame at each side thereof.

7. A method of synchronously piecing rovings for carrying out a roving bobbin exchanging operation between second roving bobbins in an almost exhausted condition and corresponding full packaged first roving bobbins, in a ring spinning frame which is provided with (a) a plurality of spindles arranged with an identical spindle pitch in an alignment along a lengthwise direction of said spinning frame at each side thereof, (b) a creel portion, (c) a plurality of draft parts arranged along said alignment of spindles at a position between said creel portion and said spindle alignment, said draft parts being positioned in relation to respective spindles and perpendicular to the lengthwise direction of said spindle alignment; a roving bobbin transporting system for introducing bobbin carriages to said creel portion of said spinning frame and for discharging said bobbin carriages therefrom, wherein said roving exchange operation is carried out between said almost exhausted second roving bobbin of said bobbin carriage positioned at said creel portion of said ring spinning frame and corresponding ones of said full packaged first roving bobbins of another bobbin carriage carried to said creel portion of said spinning frame, said method comprising the steps of:

synchronously reserving a leading free end of a roving taken from each one of a plurality of full packaged first roving bobbins at a position in proximity to a roving being fed from a corresponding one of a plurality of second roving bobbins until said second roving bobbins become almost exhausted, said reserving being done in a region generally upstream of feeding said roving to a corresponding one of said draft parts, synchronously feeding said reserved leading free end of a roving from said full packaged first roving bobbin together with a tail end portion of said roving from a corresponding one of said second roving bobbins, which is feeding to said draft part, in a doubled condition, at a time immediately before said tail end portion of said roving from said second roving bobbin is fed into said draft part;

thereby carrying out a synchronous piecing operation of said leading free end of said roving taken from said one of said full packaged first roving bobbins with said tail end position of said roving from a corresponding one of said almost exhausted second roving bobbins, while a spinning operation of said spinning frame is carried out.

8. An apparatus for providing a synchronous roving piecing operation when carrying out roving bobbin exchanging operation between almost exhausted roving bobbins and corresponding full packaged roving bobbins, in a ring spinning frame provided with (a) a plurality of spindles arranged with an identical spindle pitch in an alignment along a lengthwise direction of said spinning frame at each side thereof, (b) a creel portion, (c) a plurality of roller stands arranged on said spinning frame at a position between said creel portion and said spindle arrangement, (d) a plurality of pairs of two adjacent draft parts supported by said roller stands with a pitch identical to said spindle pitch at each side of said spinning frame with an alignment along said arrangement of said roller stands positioned so that said draft parts are oriented toward respective spindles in a direction perpendicular to the lengthwise direction of said spindle alignment, each one of said draft parts comprising a common front bottom roller and a front top roller rotatably contacting said front bottom roller under pressure, a common second bottom roller and a second top roller rotatably contacting said second bottom roller under pressure, a common back bottom roller and a back top roller rotatably contacting to said back bottom roller under pressure, said front, second and back top rollers of each pair of two adjacent draft parts provided with respective common shafts, a trumpet arranged at an upstream position of a feeding side in proximity to a contact line between said back top roller and said common back roller, (e) a plurality of top arm mechanisms each comprising a top arm for rotatably supporting said common shafts of the front, second back top rollers of each pair of two adjacent draft parts at their middle portions, a root end portion of said top arm pivoted to a corresponding one of said roller stands, means for respectively pressing each of said top arms against said common front, second and back bottom rollers during spinning operation, in combination with a transporting system for transporting bobbin carriages, each provided with a plurality of bobbin hangers for suspending the respective roving bobbins, said apparatus comprising:

a plurality of bobbin carriage supporting rails disposed in parallel at said creel portion along a lengthwise direction of said spinning frame for covering an entire length of said spinning frame, said supporting rails at least temporarily supporting said bobbin carriage for supplying rovings to corresponding draft parts of said spinning frame during a spinning operation of said spinning frame, and at least temporarily supporting said bobbin carriage for suspending a plurality of full packaged roving bobbins before carrying out said roving piecing operation, a supplemental roving feed roller disposed at a position behind the alignment of said trumpets on a feeding side of said rovings to said respective draft parts, in parallel alignment to the alignment of said draft parts, means for selectively rotating said supplemental roving feed roller, means for stopping said supplemental roving feed roller, a plurality of adjacent pairs of nip rollers arranged along said supplemental roving feed roller at respective positions thereabove so as to be capable of contacting said supplemental roving feed roller, means for supporting said adjacent pairs of nip rollers so as to be alternately rotated and stopped, said supporting means comprising a plurality of bifurcate levers, corresponding to each side of each of said top arms, having two free end portions and pivotably mounted at a position therebetween to each of said top arms, a horizontal shaft rigidly mounted on one of said two free end portions of said bifurcate lever at a middle portion thereof so that each pair of said adjacent pairs of nip rollers are mounted on respective portions projected to both sides of the respective top arm, means for synchronously pressing said adjacent pairs of nip rollers to said supplemental roving feed roller, guide means for selectively guiding a pair of rovings from said almost exhausted roving bobbin and a corresponding one of said full packaged roving bobbins so that one of said pair of rovings is introduced to said intervening space between two adjacent nip rollers, while another one of said pair of rovings is introduced to a space between one of said two nip rollers and said supplemental feed roller, and means for reciprocally displacing said guide means along said spindle alignment for a distance to carry out selective guiding of said pair of rovings thereby.

9. An apparatus according to claim 8, wherein said pressing means is provided with a resilient spring member arranged between said top arm and a part of said bifurcate lever, so that said nip rollers are pressed to said supplemental roving feed roller when said adjacent pairs of nip rollers are displaced to contact said supplemental roving feed roller, and said nip rollers are rotated under pressure when said supplemental roving feed roller is rotated.

10. An apparatus according to claim 9, wherein the number of said bobbin carriage supporting rails is two, one of said bobbin carriage supporting rails supports a bobbin carriage provided with plurality of bobbin hangers suspending respective roving bobbins from which rovings are supplied to a respective one of said draft parts of said each side of said spinning frame, the other of said bobbin carriage supporting rails supports another bobbin carriage provided with bobbin hangers suspended from a respective one of said full packaged roving bobbins, the number of bobbin hangers of each one of said bobbin carriages is identical to the number of said draft parts of said each side of said spinning frame, said guide means comprises a horizontal rod extended along said spindle alignment for the entire length of said alignment of spindles at said each side of said spinning frame, a plurality of sets of three guide pins, projecting perpendicular to roving path travel, with a pitch identical to said spindle pitch in an alignment along said spindle alignment, each set of said three pins assuming respective positions for feeding said two rovings to a corresponding one of said draft parts, whereby rovings from said roving bobbins and a corresponding one of said full packaged roving bobbins are guided to the respective positions, one of which positions is for introducing one of said two rovings to said intervening space between said supplemental feed roller and a portion of said horizontal shaft between said pair of nip rollers, while another one of said positions is for introducing the other one of said rovings to one of said intervening spaces between said either one of said two nip rollers and said supplemental feed roller, whereby said two rovings are capable of being introduced into said trumpet of a corresponding one of said draft parts, in a doubled condition, when said roving piecing operation is carried out.

11. An apparatus according to claim 9, wherein the number of said roving bobbin supporting rails is three, each of said three bobbin carriages supporting rails is utilized to temporarily support said bobbin carriage provided with a plurality of bobbin hangers arranged in an alignment along a lengthwise direction thereof, the number of said bobbin hangers of each of said bobbin carriages is $\frac{1}{2}$ of the number of draft parts of said each side of said spinning frame, a first one of said three bobbin carriages is always utilized to temporarily support two of said bobbin carriages, a second one of said three bobbin carriages being provided with said bobbin hangers, each of said first and second bobbin carriages suspending smaller size roving, which are half exhausted roving bobbins, when the other one of said first and second bobbin carriages, being provided with said bobbin hangers, suspends a larger size roving bobbin which will become half exhausted when said smaller size roving bobbins become almost exhausted, a remaining one of said three bobbin carriages supporting rails being utilized to temporarily support said one of said first and second bobbin carriages provided with bobbin hangers suspending full packaged roving bobbin, whereby rovings from said roving bobbins of said first one of said two bobbin carriages and rovings from said roving bobbins from said second one of said two bobbin carriages are alternately supplied to corresponding draft parts belonging to two groups of draft parts, one of said two groups consisting of all odd number draft parts counted from an end of said spinning frame and another one of said two groups consisting of all even number draft parts counted from said end of said spinning frame from one side to the other side of said alignment of said draft parts, respectively, such that each of said odd number draft parts receives said roving from a corresponding one of said smaller size roving bobbins, while each of said even number of draft parts receives said roving from a corresponding one of said larger size roving bobbins, and vice versa.

12. An apparatus according to claim 11, wherein said guide means comprises a pair of horizontal rods arranged at a region of an upstream feeding side of said draft parts along said alignment of draft parts of said each side of said spinning frame which extend to cover the entire length of said alignment of said draft parts, means for separately and reciprocally displacing either one of said horizontal rods by a predetermined distance along the lengthwise direction thereof, each one of said rods provided with a plurality of sets of three pins, projecting perpendicular to roving path travel, in an alignment with double said spindle pitch along a lengthwise direction thereof, one of said two groups of draft parts receives said roving from a corresponding one of said roving bobbin of a smaller size through a corresponding one of said sets of three pins of either one of said two horizontal rods, while another one of said two groups of draft parts receives said roving from a corresponding one of said larger size roving bobbins through a corresponding one of said sets of three pins formed on the other one of said horizontal rods, each set of three pins of either one of said horizontal rods assumes respective positions for feeding said two rovings to a corresponding one of said draft parts, whereby said pair of rovings, one of which is a roving from said roving bobbins of a smaller size and the other one is a roving from a corresponding one of said full packaged roving bobbin, are guided to respective positions, one of which positions is for introducing one of said two rovings to an intervening space between said supplemental roving feed roller and a portion of said horizontal shaft between said pair of nip rollers, while another one of said positions is for introducing the other one of said two rovings to one of intervening spaces between either one of said two nip rollers and said supplemental feed roller, whereby said two rovings are capable of being introduced into said trumpet of a corresponding one of said draft parts in a doubled condition when said roving piecing operation is carried out.

13. An apparatus according to claim 11, wherein said guide means comprises a rotatable line shaft, having a first side and opposite second side, arranged at a region of an upstream feeding side of said draft parts along said alignment of draft parts and extended to cover an entire length of said alignment of draft parts, means for selectively rotating said line shaft by half a rotation each time said roving piecing operation is carried out and for displacing said shaft towards either one of the axial directions thereof for a predetermined distance of ½ of said pitch between said pair of nip rollers reciprocally when said roving piecing operation is carried out, said line shaft being provided with a first group of pairs of guide grooves formed on said first side of said line shaft along a lengthwise direction thereof, a second group of guide grooves formed on said second side of said line shaft along the lengthwise direction thereof, wherein each groove of the first group of pairs of guide grooves is transversely formed on the first side of a peripheral surface of said line shaft while each groove of the second group of pairs of grooves is transversely formed on the second side of a peripheral surface of the line shaft, such that said pairs of guide grooves of said first and second groups are arranged along the lengthwise direction of said line shaft with an identical intervening pitch between two adjacent pairs of guide grooves, which is double an intervening pitch between two adjacent spindles, each pair of said guide grooves assuming respective positions for feeding said roving from a corresponding one of said almost small size roving bobbins and said roving from a corresponding one of said full packaged roving bobbins to said trumpet of a corresponding one of said draft parts, whereby said rovings are guided to respective positions, one of which positions is for introducing one of said two rovings to an intervening space between said supplemental roving feed roller and a portion of said horizontal shaft between said pair of nip rollers, while another one of said positions is for introducing another one of said two rovings to one intervening space between either one of said two nip rollers and said supplemental roving feed roller so that said two rovings are capable of being introduced into said trumpet of said corresponding one of said draft parts in a doubled condition, wherein said two positions are relatively changed each time said roving bobbin exchanging operation is carried out by rotating said line shaft about an axis thereof, whereby said roving piecing operation is carried out by displacing said line shaft, for said predetermined distance identical to ½ of said spindle pitch, towards an axial direction thereof after introducing said roving of a smaller size roving bobbin together with a leading end of a corresponding one of said full packaged roving bobbins into said trumpet of a corresponding one of said draft parts so that said roving from said smaller size roving bobbin is cut by stopping rotation of said supplemental feed roller and said line shaft is turned half way about the axis thereof each time before said roving bobbin exchange operation is carried out, so that each pair of said guide grooves assumes the respective positions for guiding said two rovings to a corresponding draft part.

14. An apparatus according to claim 8, further provided with means for positively cutting said roving from each one of said almost exhausted roving bobbins at an upstream feeding position to said trumpet of corresponding draft parts right before feeding said roving from a corresponding one of said full packaged roving bobbins to said trumpet.

* * * * *